US012662764B2

(12) United States Patent
Jung et al.

(10) Patent No.: US 12,662,764 B2
(45) Date of Patent: Jun. 23, 2026

(54) LAUNDRY TREATING APPARATUS

(71) Applicant: LG ELECTRONICS INC., Seoul (KR)

(72) Inventors: Sungwoon Jung, Seoul (KR); Younghun Kim, Seoul (KR); Kunwoo Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 87 days.

(21) Appl. No.: 18/701,362

(22) PCT Filed: Dec. 8, 2022

(86) PCT No.: PCT/KR2022/019943
§ 371 (c)(1),
(2) Date: Apr. 15, 2024

(87) PCT Pub. No.: WO2024/117350
PCT Pub. Date: Jun. 6, 2024

(65) Prior Publication Data

US 2025/0243617 A1 Jul. 31, 2025

(30) Foreign Application Priority Data

Nov. 30, 2022 (KR) ..... 10-2022-0165049

(51) Int. Cl.
*D06F 37/24* (2006.01)
*D06F 39/02* (2006.01)
*D06F 39/12* (2006.01)

(52) U.S. Cl.
CPC ..... *D06F 39/022* (2013.01); *D06F 37/24* (2013.01); *D06F 39/024* (2013.01); *D06F 39/12* (2013.01)

(58) Field of Classification Search
None
See application file for complete search history.

(56) References Cited

U.S. PATENT DOCUMENTS

2011/0052955 A1 3/2011 Chu
2022/0010474 A1* 1/2022 Kim ..... D06F 23/025

FOREIGN PATENT DOCUMENTS

CN 108729147 B 3/2021
JP 2002-11282 A 1/2002
(Continued)

*Primary Examiner* — Levon J Shahinian
(74) *Attorney, Agent, or Firm* — Birch, Stewart, Kolasch & Birch, LLP

(57) ABSTRACT

A laundry treating apparatus includes a cabinet having a top cover with a laundry inlet defined therein, a tub disposed inside the cabinet to store water therein, a drum rotatably disposed inside the tub and storing laundry therein, a mounting portion disposed on the top cover to be exposed to the outside, a storage detachably coupled to the mounting portion and storing detergent therein, a storage protrusion protruding downward from the storage and inserted into the mounting portion, and a storage coupling portion disposed on the storage to be spaced apart from the storage protrusion in a direction parallel to the ground. The storage coupling portion is able to be coupled to the mounting portion. The storage protrusion is restricted from moving in one direction by being inserted into the mounting portion so as to be detachable upward and is restricted from moving upward as at least a portion thereof is inserted into the mounting portion and the storage coupling portion and the mounting portion are coupled to each other.

20 Claims, 12 Drawing Sheets

(56) References Cited

FOREIGN PATENT DOCUMENTS

| | | | |
|---|---|---|---|
| KR | 20-1991-0006231 | Y1 | 8/1991 |
| KR | 20-0110012 | Y1 | 12/1997 |
| KR | 2000-0009638 | A | 2/2000 |
| KR | 10-2005-0118617 | A | 12/2005 |
| KR | 10-2018-0080013 | A | 7/2018 |
| KR | 10-2021-0027019 | A | 3/2021 |

* cited by examiner

[FIG. 1]
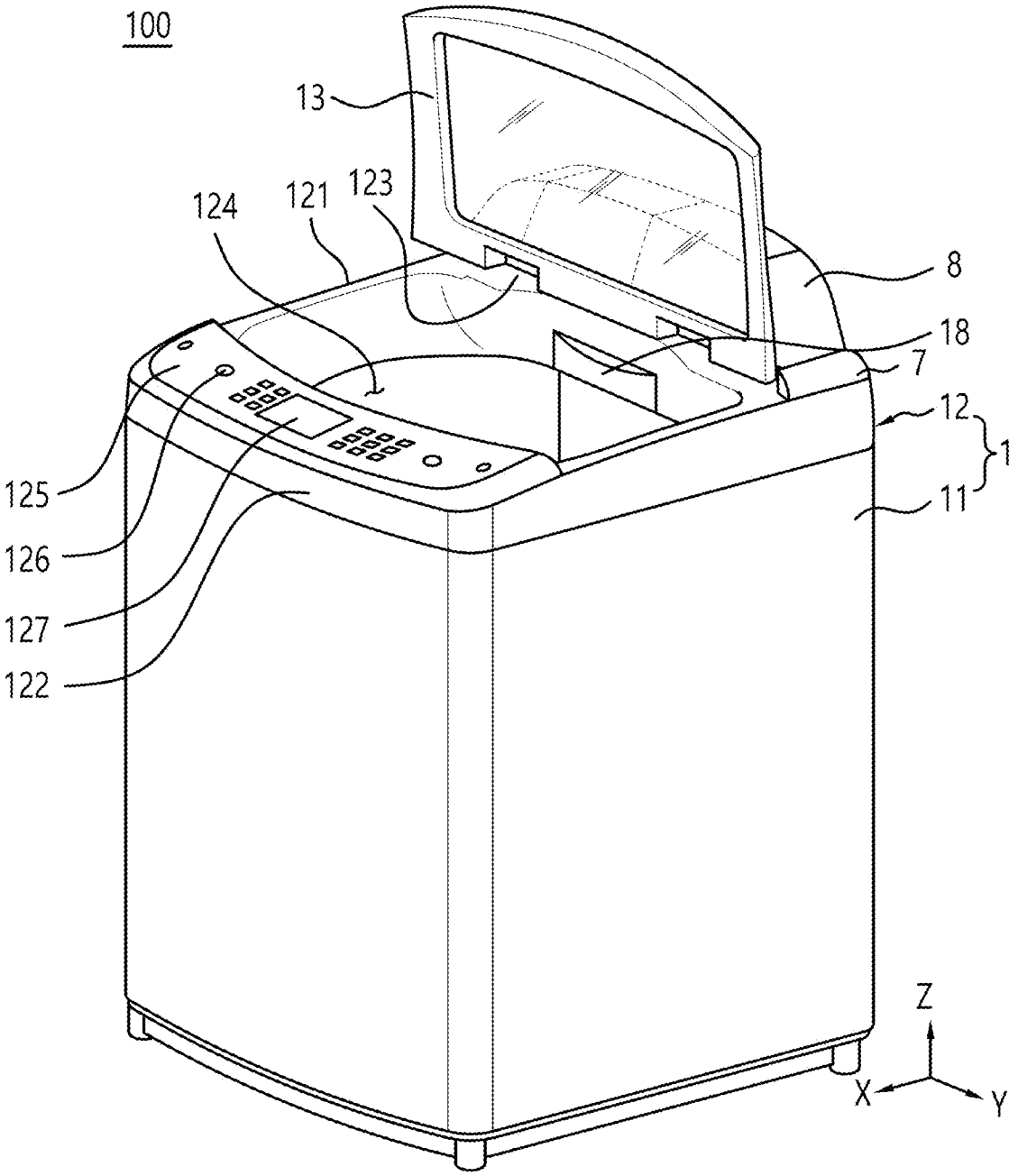

【Fig. 2】
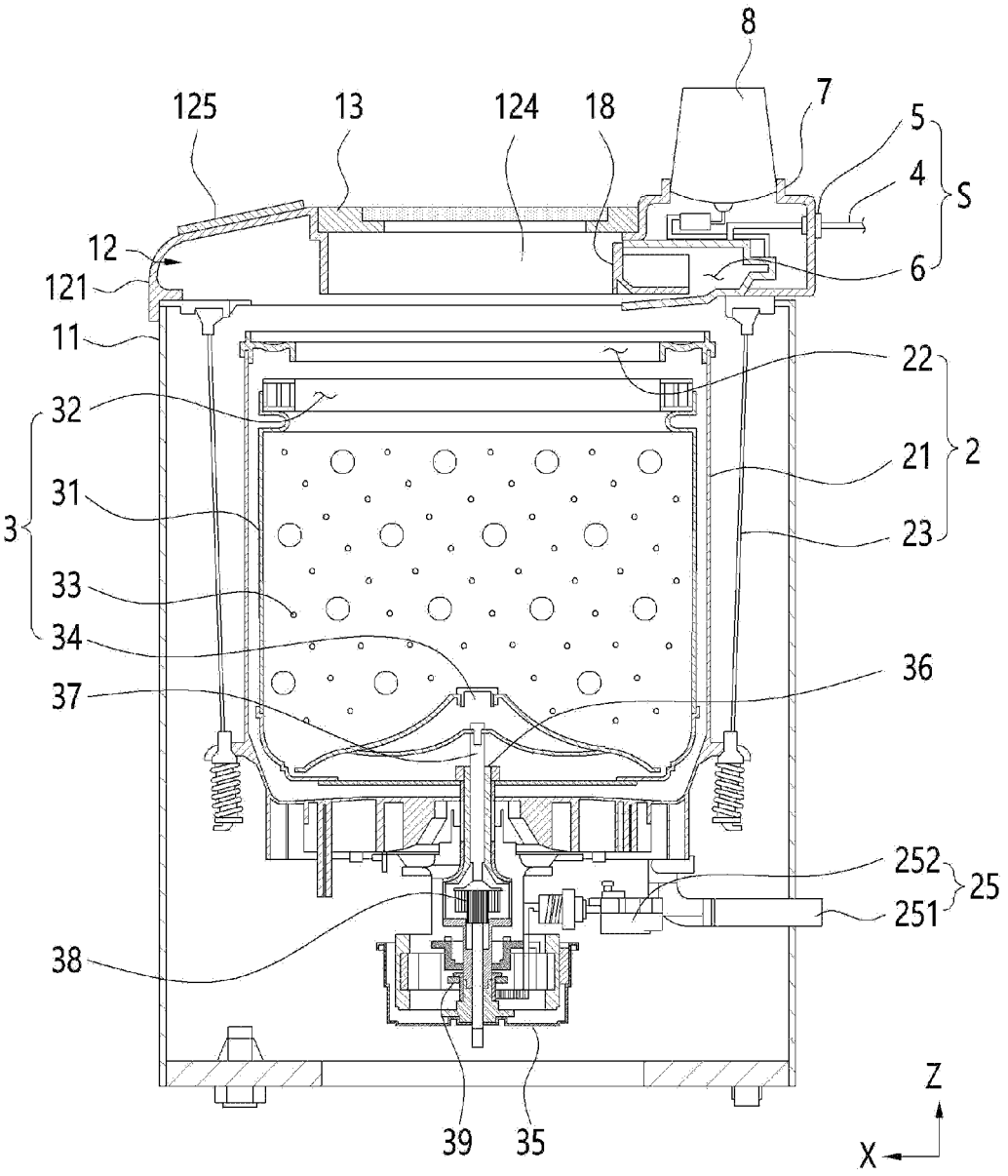

【Fig. 3】
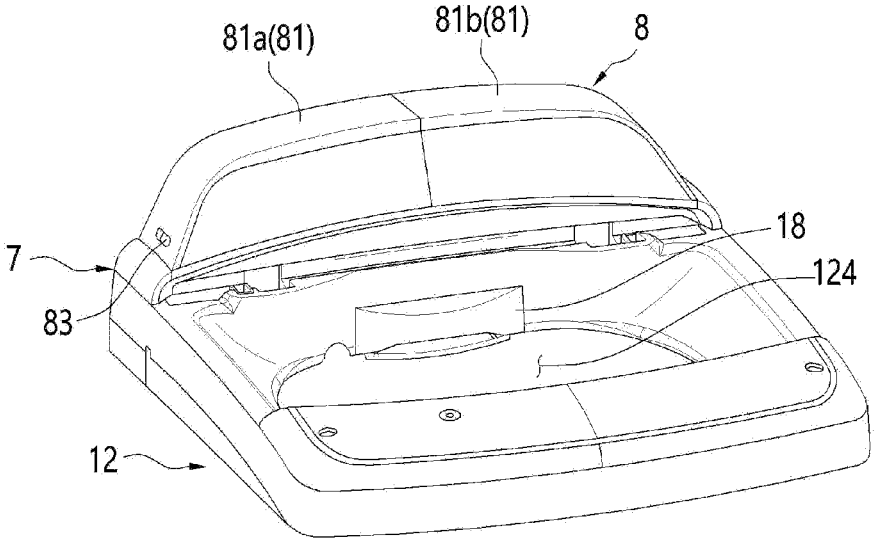
【Fig. 4】
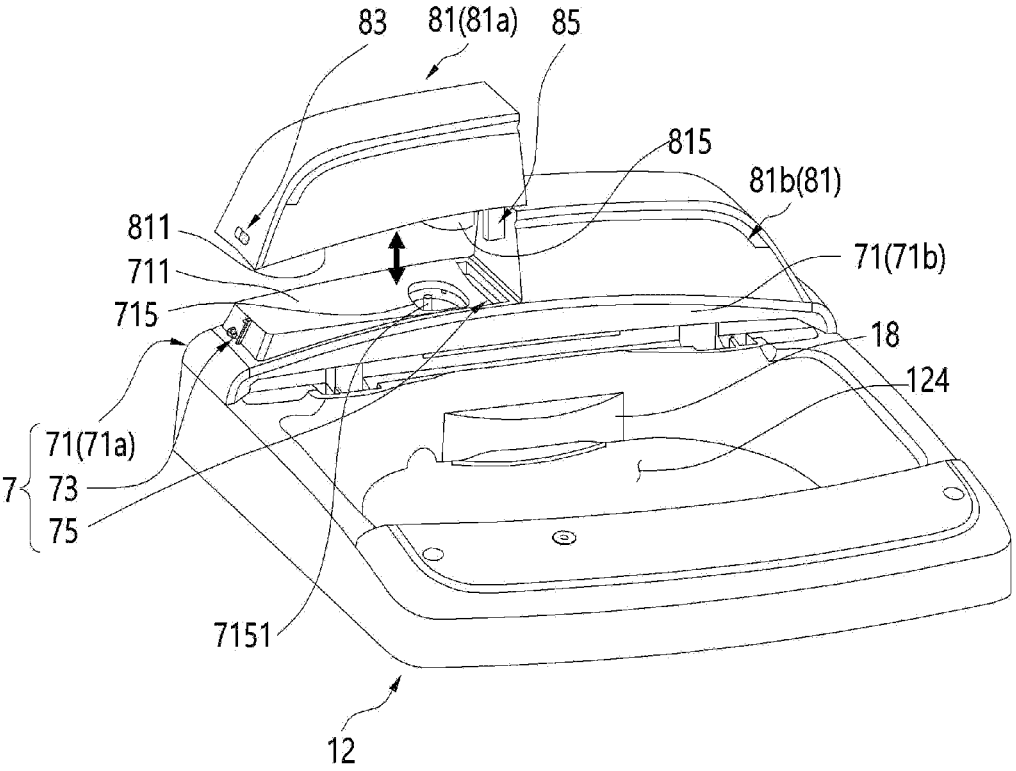

[Fig. 5]
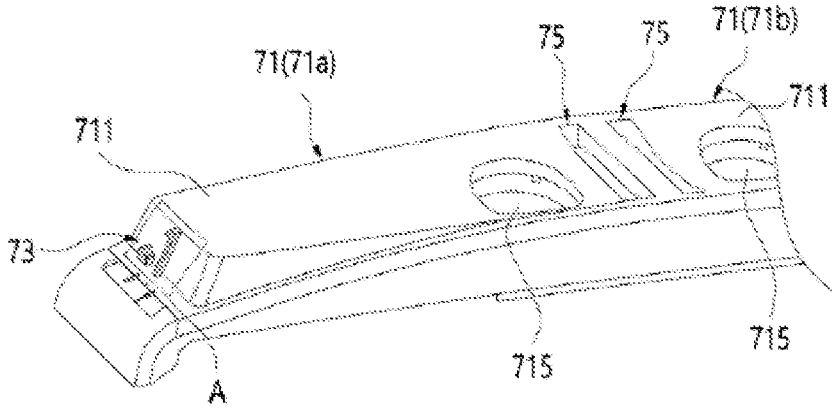
[FIG. 6]
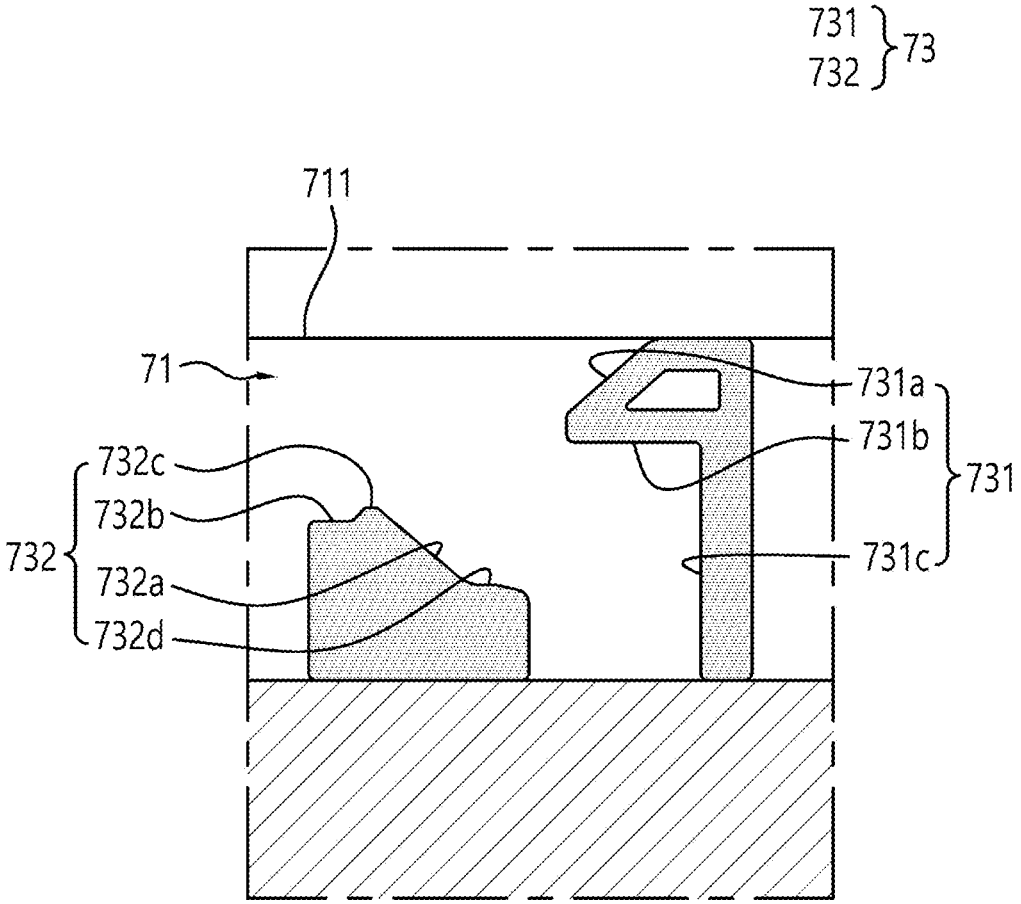

【Fig. 7】
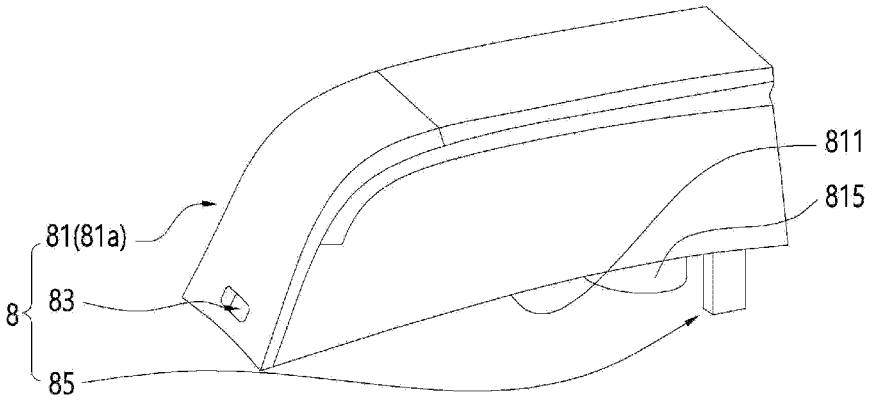
【Fig. 8】
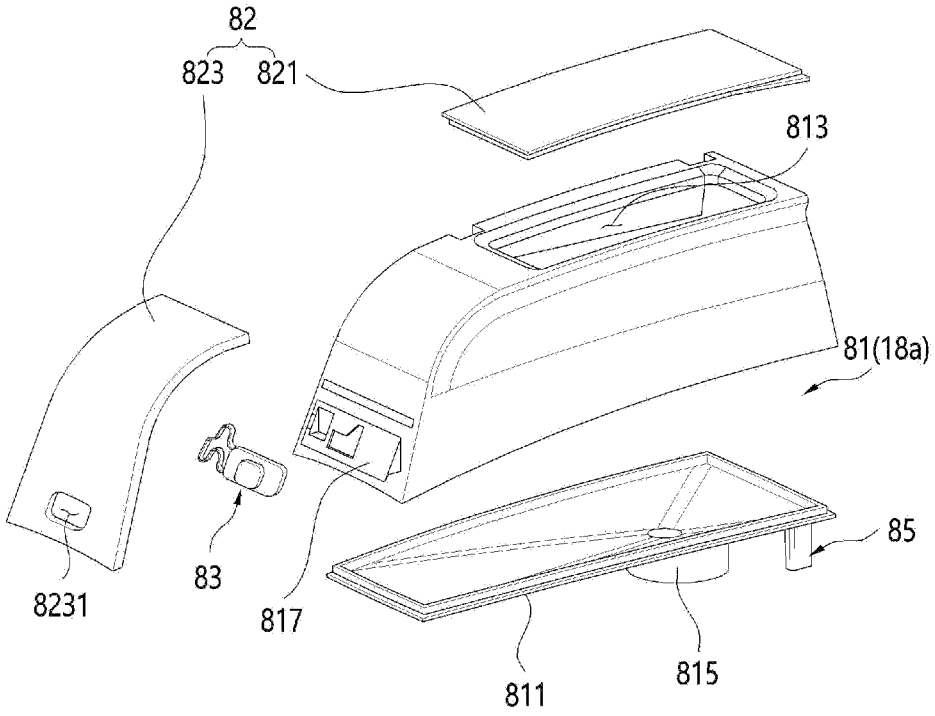

[Fig. 9]
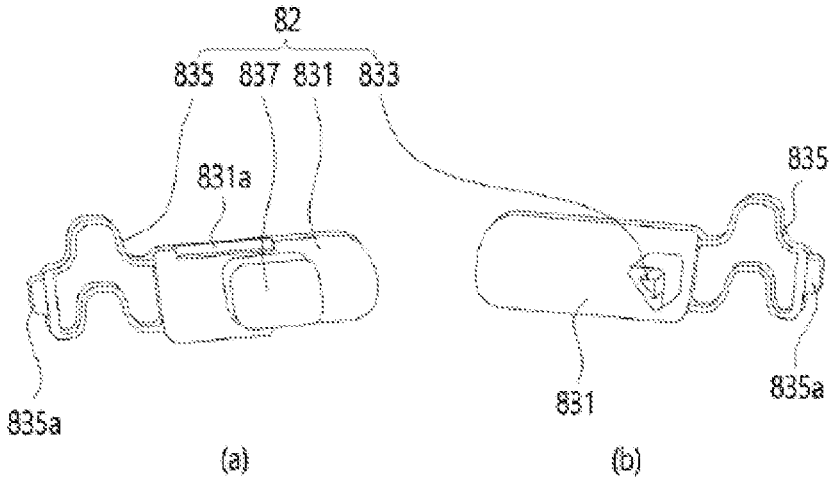
[FIG. 10]
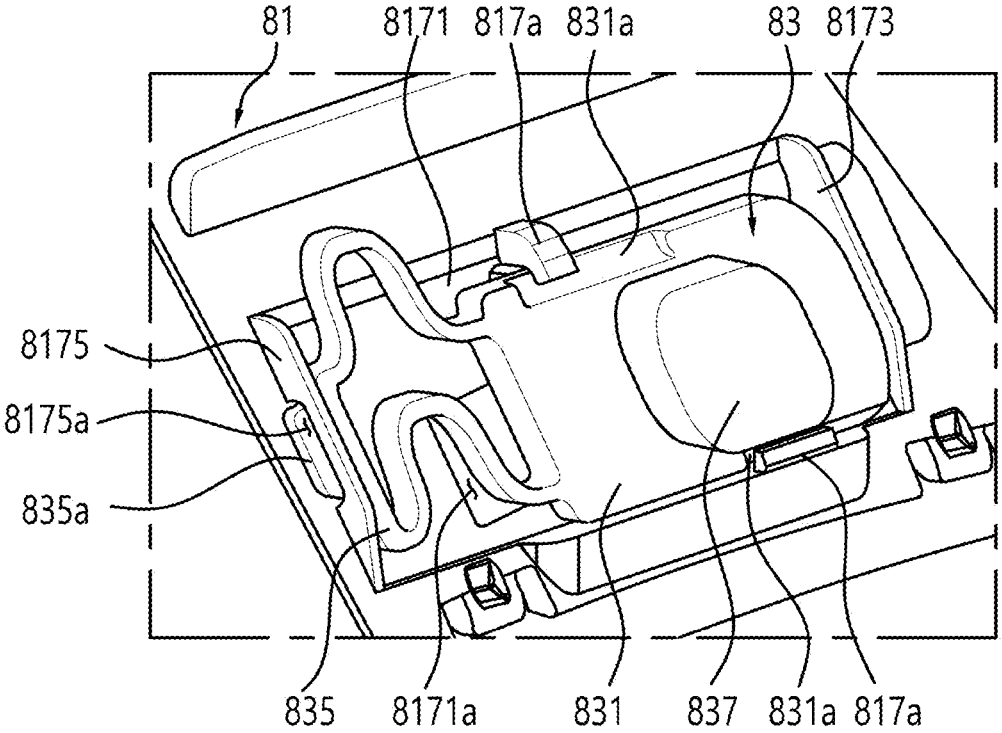

【Fig. 11】
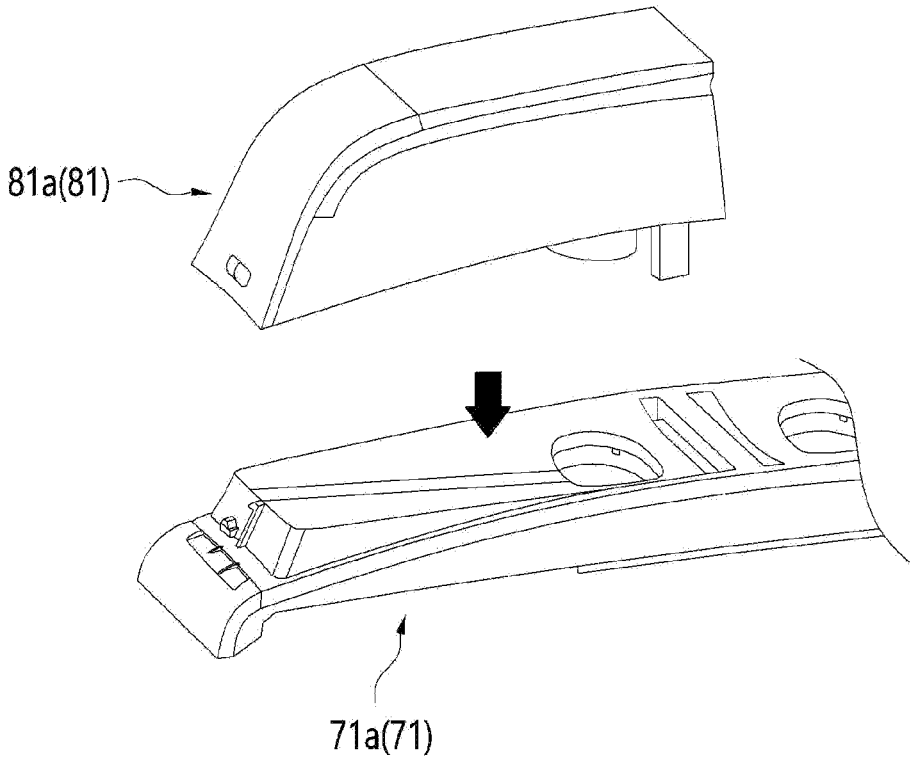
【Fig. 12】
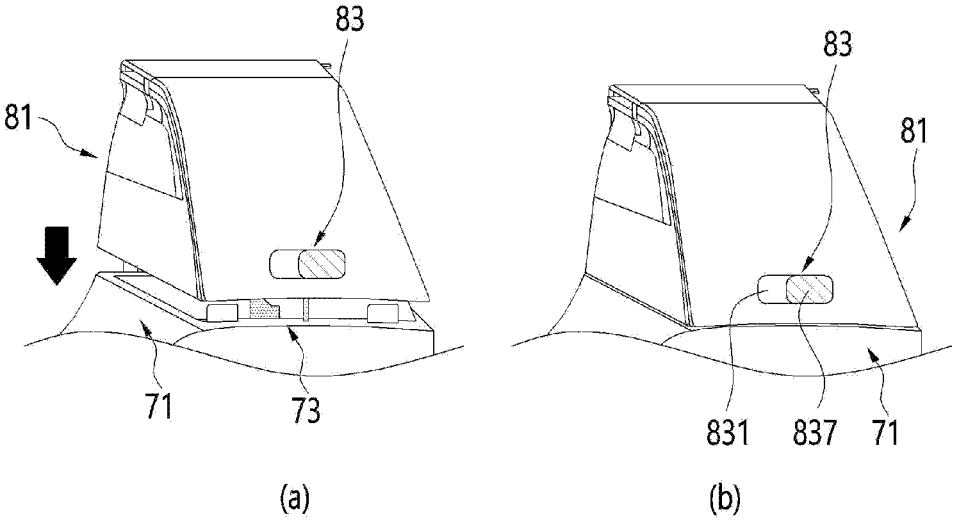

【Fig. 13】
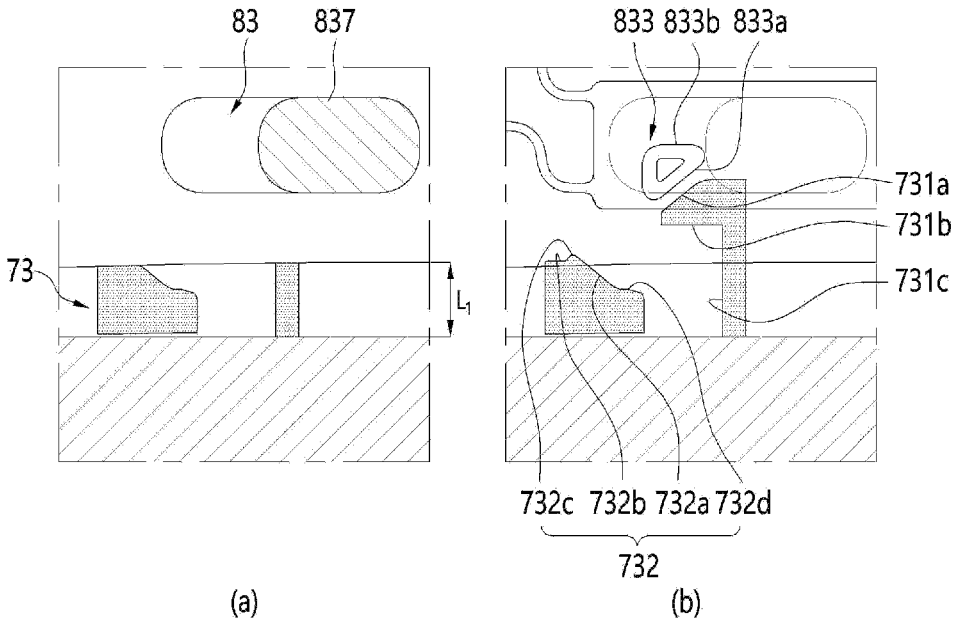
【Fig. 14】
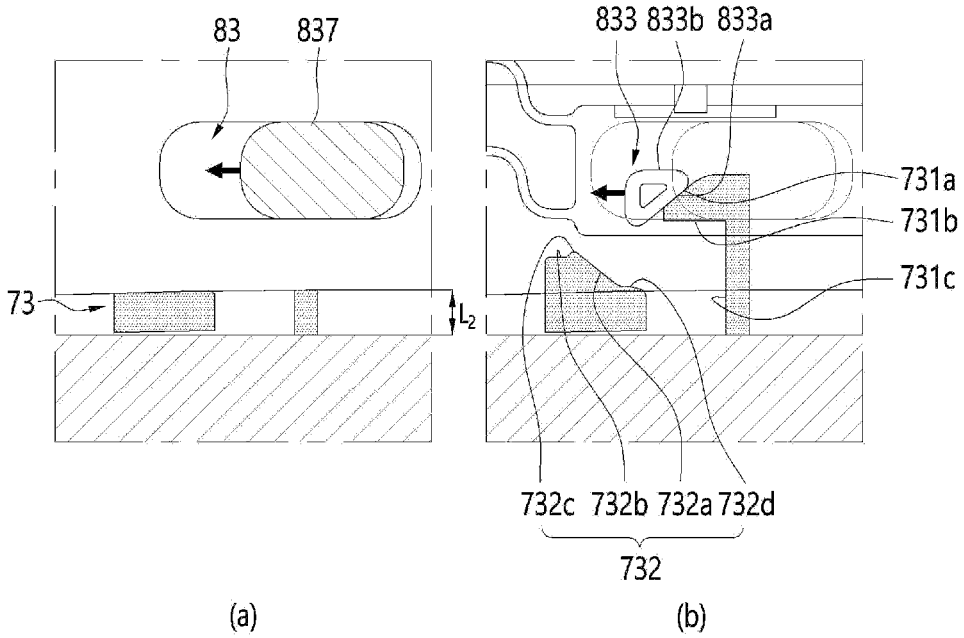

【Fig. 15】
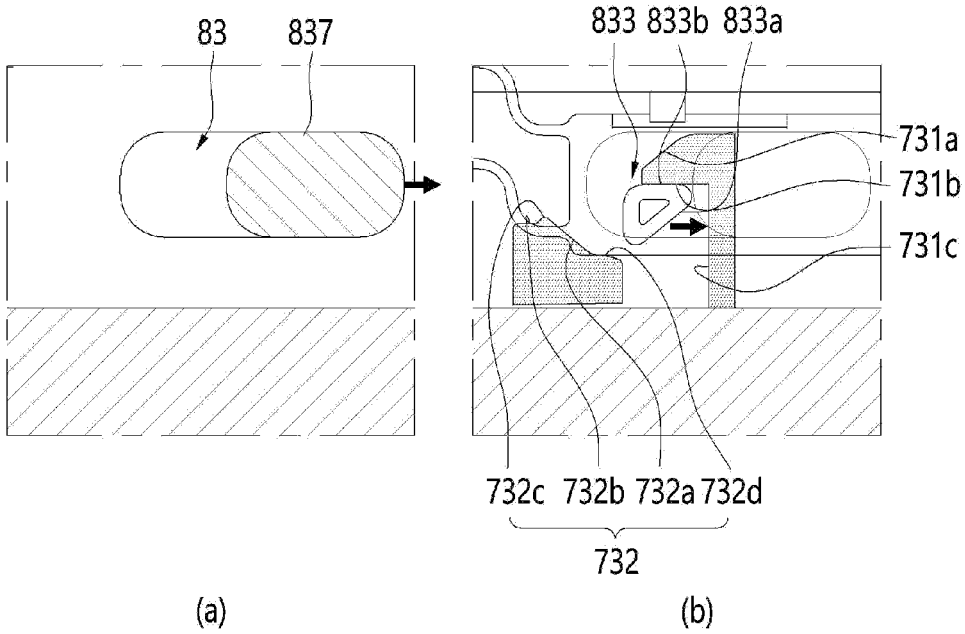
【Fig. 16】
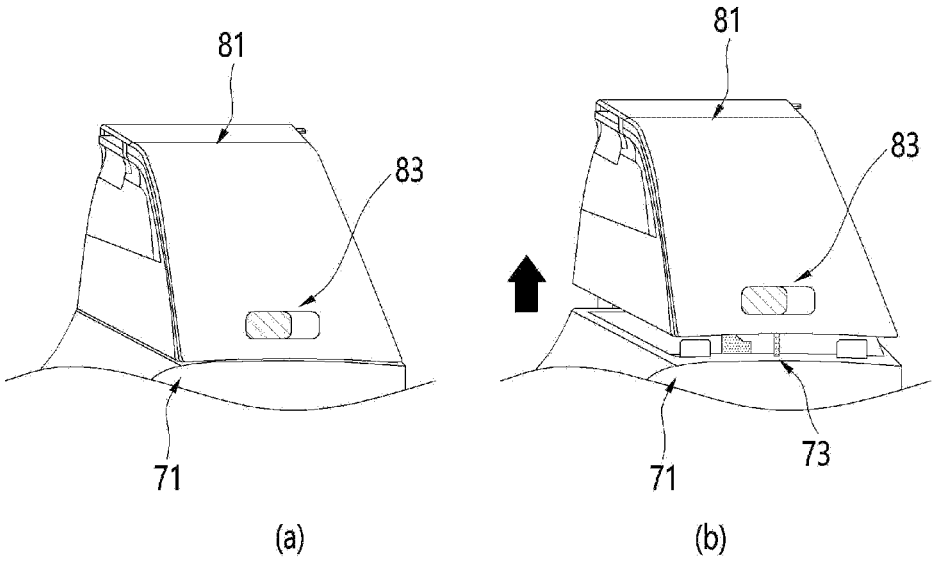

【Fig. 17】
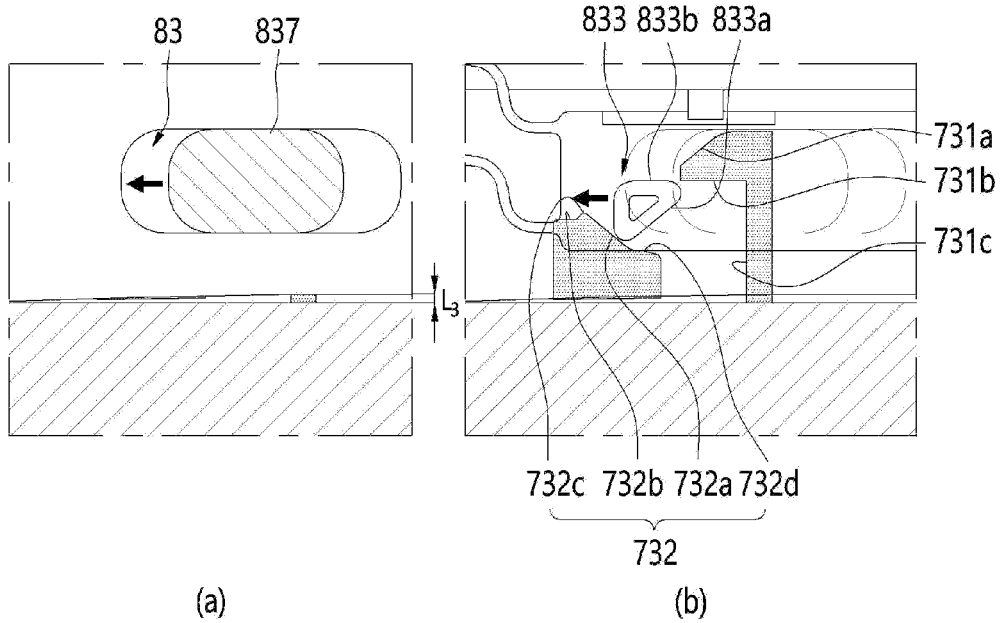
【Fig. 18】
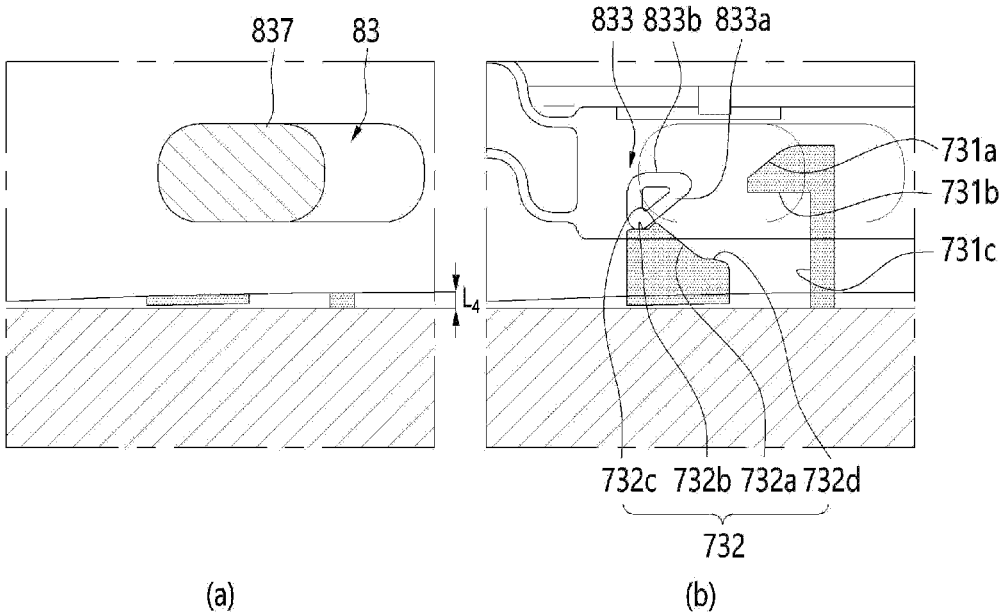

【Fig. 19】
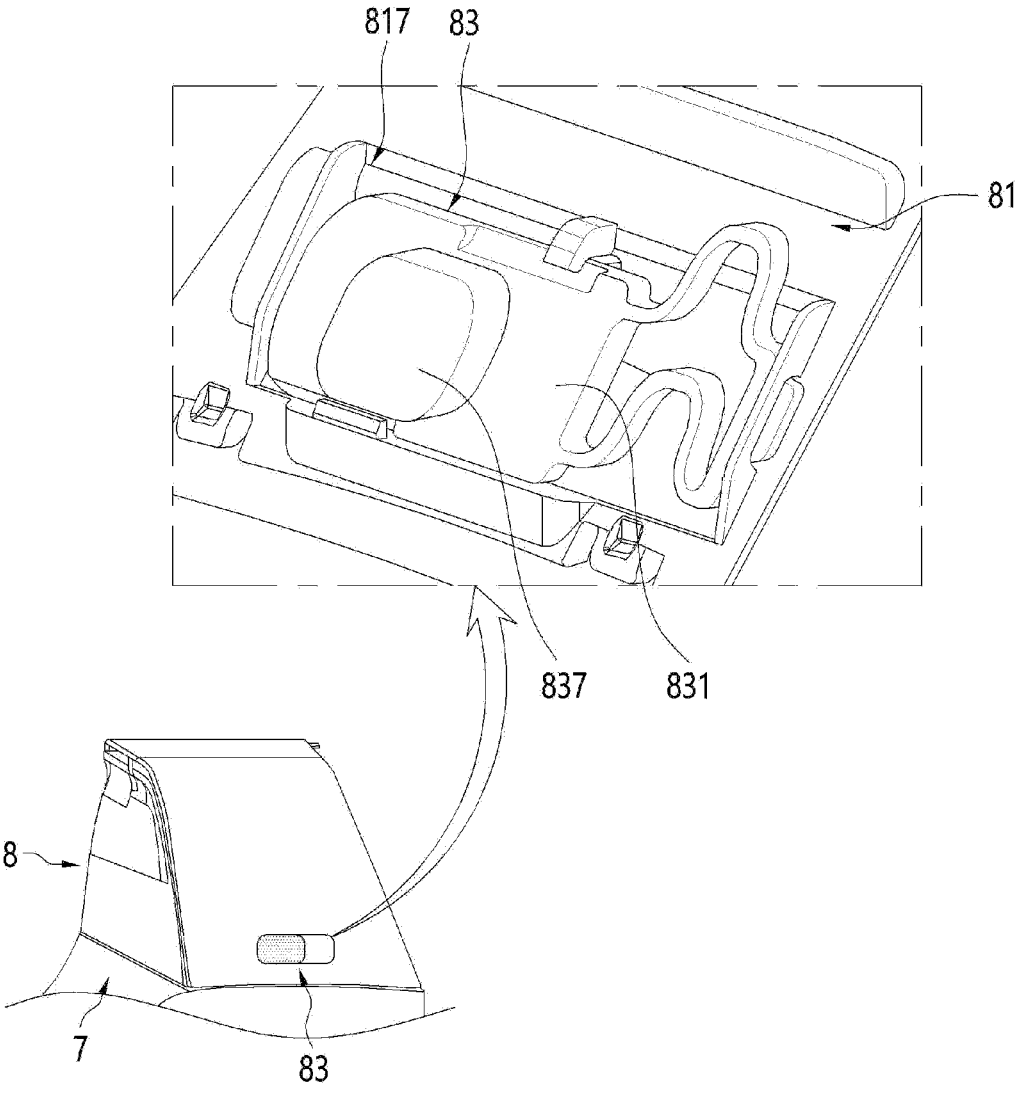

[FIG. 20]
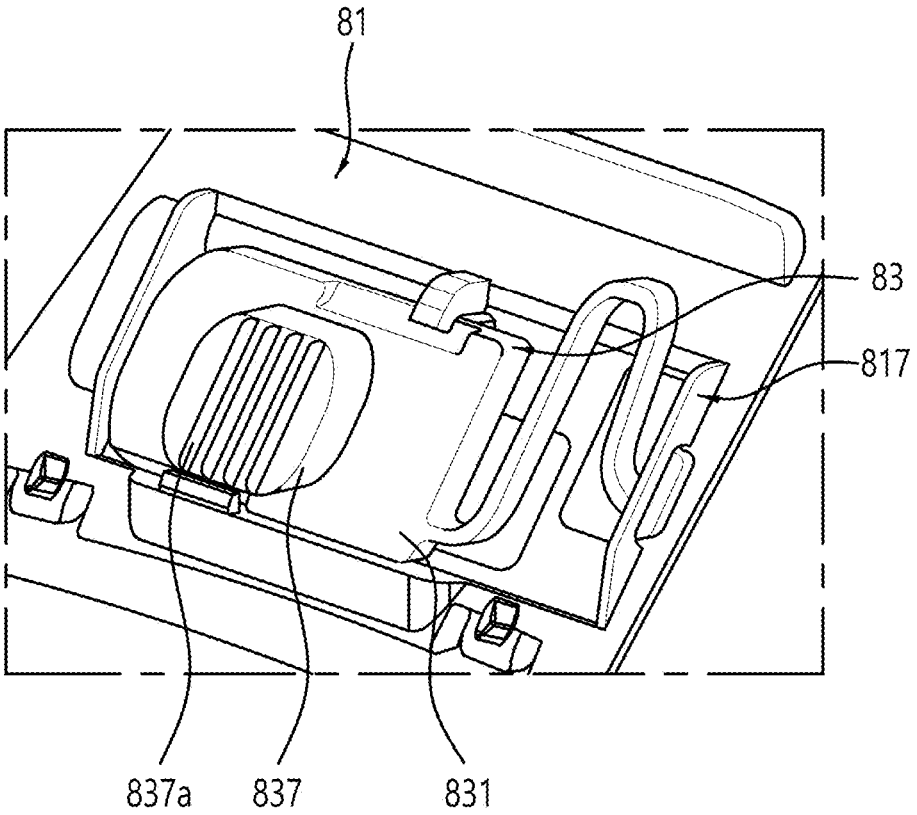
[FIG. 21]
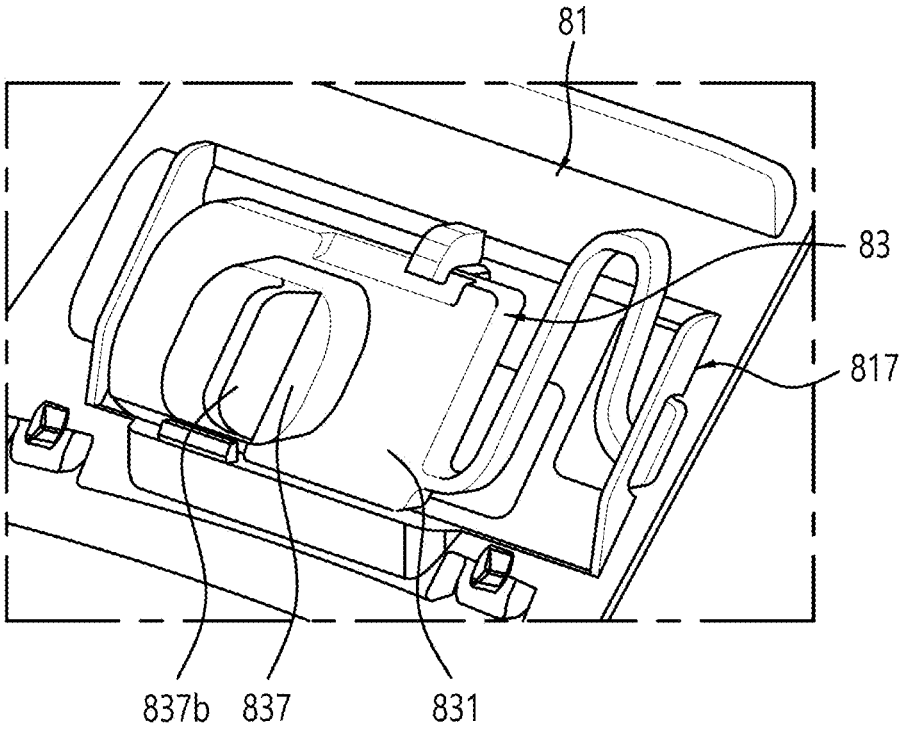

LAUNDRY TREATING APPARATUS

CROSS REFERENCE TO RELATED APPLICATIONS

This application is the National Phase of PCT International Application No. PCT/KR2022/019943, filed on Dec. 8, 2022, which claims priority under 35 U.S.C. 119(a) to Patent Application No. 10-2022-0165049, filed in the Republic of Korea on Nov. 30, 2022, all of which are hereby expressly incorporated by reference into the present application.

TECHNICAL FIELD

The present disclosure relates to a laundry treating apparatus. More specifically, the present disclosure relates to a laundry treating apparatus that supplies steam and hot air to laundry to perform a refresh process such as sterilization, wrinkle removal, deodorization, and dry of the laundry.

BACKGROUND

Generally, a laundry treating apparatus is a home appliance that removes foreign substances from laundry using water and detergent, and includes a tub that stores water therein, a water supply that supplies water to the tub, and a detergent supply that is disposed in a flow channel connecting the water supply with the tub and supplies the detergent to the tub along with the water.

In the existing laundry treating apparatus, the detergent supply is simply constructed as a space for storing the detergent therein, and a scheme of injecting detergent needed into the detergent supply each time a user performs washing of the laundry is applied.

Although such existing laundry treating apparatus was able to guarantee the user autonomy to select a type and an amount of the detergent needed, there was a fundamental problem in that it is difficult to expect injection of a required appropriate amount of detergent.

In addition, in such a laundry treating apparatus, when the detergent supply receives water, all the detergent stored in the detergent supply is injected into the tub, so that there was inconvenience of having to newly add the detergent each time the washing is performed.

To overcome such problem, a laundry treating apparatus in which the detergent supply is controlled by a controller disposed in the laundry treating apparatus to supply the appropriate amount of detergent has emerged (see Korean Patent Application Publication No. 2000-0009638).

The existing laundry treating apparatus is equipped with an automatic detergent supply device including a storage in which the detergent supply stores the detergent, and a valve that automatically supplies the detergent received in the storage to the tub.

Such a laundry treating apparatus had the advantage that only the appropriate amount of detergent is able to be supplied even when a large amount of detergent is stored in the storage as the controller is able to calculate an optimal amount of detergent based on an amount of laundry, an amount of water supply, and the like.

However, the laundry treating apparatus had a limitation in that the storage is formed integrally with a cabinet or the like and thus is not able to be removed. As a result, in the laundry treating apparatus, the storage was not able to be cleaned separately when the foreign substances are introduced into the storage or the storage is contaminated, so that there was a possibility that the automatic detergent supply device may be damaged or the laundry may be contaminated by the detergent stored in the storage.

In particular, the laundry treating apparatus had a fundamental limitation in that it is difficult to maintain and repair the storage because, when the user injects incorrect detergent or the foreign substances into the storage, there is no way to easily remove the same.

To overcome such problem, a laundry treating apparatus with the storage that may be removed therefrom has emerged (Korean Patent Application Publication No. 10-2021-0027019).

The laundry treating apparatus is constructed such that the storage may be removed from the flow channel that supplies the detergent and completely extended to the outside. Therefore, when the storage is contaminated or the foreign substances are introduced into the storage, the storage may be easily cleaned, and when detergents other than the appropriate detergent or the foreign substances are injected into the storage, the detergents or the foreign substances may be easily removed.

A large amount of detergent must be injected into the storage to reduce the number of times the user injects the detergent into the storage. Therefore, the storage needed to be increased in volume to accommodate the detergent of an amount that may perform multiple washing processes.

The existing laundry treating apparatus is equipped with a drawer-type housing that accommodates and supports an entirety of the storage so as to stably support the heavy and bulky storage.

Because the housing is equipped with all closed surfaces except for an open surface from which the storage is extended, the housing was able to support four or more surfaces of the storage. As a result, the existing laundry treating apparatus was able to stably support the storage even when great vibrations occur.

However, for the storage of the automatic detergent supply device to be completely accommodated in the housing (hereinafter, referred to as the drawer type), it was general that the laundry treating apparatus is of a front load type with a laundry inlet through which the laundry is inserted defined in a front surface, like the existing laundry treating apparatus.

In the front load-type washing machine, a drum that accommodates the laundry therein is constructed to rotate about a rotation axis that is parallel or slightly inclined to the ground, and the tub that accommodates the drum therein is also formed in a cylindrical shape disposed in a front and rear direction. Therefore, the existing front load-type washing machine had an advantage that a space where the drawer-type automatic detergent supply device is able to be installed may be secured at a front edge of the cabinet.

In particular, because the front load-type washing machine does not have a door on a top surface thereof, there was also an advantage that a separate automatic detergent supply device may be disposed at a top of the cabinet.

However, such drawer-type automatic detergent supply device had a problem in that it is difficult to be applied to a top load-type washing machine in which the laundry inlet of the laundry is defined at a top surface of the cabinet.

Nevertheless, recently, a laundry treating apparatus equipped with the drawer-type automatic detergent supply device in the top load-type washing machine has appeared (see Korea Patent Application Publication No. 10-2018-0080013).

In the laundry treating apparatus, the drawer-type automatic detergent supply device is applied to the top load-type washing machine equipped with the laundry inlet through which the laundry is inserted defined in the top surface of the cabinet, and the door that opens and closes the opening.

In the top load-type washing machine, because a suspension or the like that supports the tub is fixed to an edge of the cabinet, it was difficult to install the automatic detergent supply device inside the cabinet, and even when the automatic detergent supply device is installed, it was difficult to a capacity of the storage or install a water supply flow channel.

Additionally, in the top load-type washing machine, when the automatic detergent supply device is disposed in front of the door or the laundry inlet, the automatic detergent supply device interferes with the insertion of the laundry into the laundry inlet or the opening of the door.

Therefore, in the existing laundry treating apparatus, the automatic detergent supply device is disposed at the rear of the door or the laundry inlet and the automatic detergent supply device is of the drawer type in which the storage is extended forward.

However, the automatic detergent supply device requires installation of a pump that discharges the detergent stored in the storage or a connector that connects the pump with the storage. When the automatic detergent supply device is of the drawer type, the pump or the connector must be installed on a surface opposite to the surface into which the storage is input, and as a result, the storage must be spaced forwardly apart from a rea surface of the laundry treating apparatus as much as a space in which the pump or the connector must be installed.

That is, when the drawer-type automatic detergent supply device that is extended forward is installed in the top load-type washing machine like the existing laundry treating apparatus, all of the storage and the pump/connector must be installed in a space from a rear portion of the cabinet to a rear surface of the laundry inlet or the door. As a result, the existing laundry treating apparatus had a fundamental problem in that an area size of the laundry inlet or the door is reduced, making it inconvenient put in and out the laundry.

Moreover, the existing laundry treating apparatus had a problem in that it is difficult to sufficiently secure a thickness in the front and rear direction of the storage even when the area size of the laundry inlet or the door is reduced, and thus a volume of the storage is not able to be sufficiently expanded.

SUMMARY

Technical Problem

The present disclosure is to provide a laundry treating apparatus in which a storage storing detergent therein may be stably and detachably fixed at a location outside a cabinet while being exposed to the outside in an automatic detergent supply device of a top load-type washing machine.

The present disclosure is to provide a laundry treating apparatus in which a storage in a top load-type washing machine is fixed and separated outside of a cabinet in a vertical movement scheme, but is able to remain fixed despite a vibration, an impact, and the like.

The present disclosure is to provide a laundry treating apparatus in which a storage in a top load-type washing machine is firmly coupled to a cabinet in a vertical movement scheme, but is able to be easily separated depending on an intention of a user.

The present disclosure is to provide a laundry treating apparatus that has a coupling structure that may maintain a state in which a storage is firmly mounted on a mounting portion even with a vibration or the like as a storage coupling portion is restricted from moving upward when the storage coupling portion is coupled to the mounting portion even when the storage protrusion is coupled to the mounting portion so as to be movable upward.

The present disclosure is to provide a laundry treating apparatus in which, even when a storage is detachably coupled to a cabinet in a vertical movement scheme in a top load-type washing machine, the storage is not arbitrarily separated as long as a fixing protrusion is disposed at a first location.

The present disclosure is to provide a laundry treating apparatus that allows a storage to be separated upwardly from a mounting portion when a fixing protrusion is moved to a second location even when the storage is coupled to the mounting portion in a top load-type washing machine.

Technical Solutions

A laundry treating apparatus includes a cabinet having a top cover with a laundry inlet defined therein, a tub disposed inside the cabinet to store water therein, a drum rotatably disposed inside the tub and storing laundry therein, a mounting portion disposed on the top cover to be exposed to the outside, a storage detachably coupled to the mounting portion and storing detergent therein, a storage protrusion protruding downward from the storage and inserted into the mounting portion, and a storage coupling portion disposed on the storage to be spaced apart from the storage protrusion in a direction parallel to the ground, wherein the storage coupling portion is able to be coupled to the mounting portion, and the storage protrusion is restricted from moving in one direction by being inserted into the mounting portion so as to be detachable upward and is restricted from moving upward as at least a portion thereof is inserted into the mounting portion and the storage coupling portion and the mounting portion are coupled to each other.

The storage coupling portion may include a fixing body disposed on the storage so as to be movable in the direction parallel to the ground, and a fixing protrusion protruding from the fixing body and fastened to the storage, and the fixing body may be disposed on the storage so as to move between a first location where the fixing protrusion is disposed to be caught on the mounting portion and restricted from moving upward and a second location where the fixing protrusion is disposed to be separated from the mounting portion.

The fixing body may be disposed at the first location as the storage coupling portion is coupled to the mounting portion, and the coupling of the storage coupling portion and the mounting portion may be released as the fixing body moves to the second location.

The laundry treating apparatus may further include an elastic portion disposed on the fixing body and applying a force to the fixing body in a direction of the first location such that the fixing body is located at the first location, and a guide guiding the fixing body to move to the first location and the second location.

The fixing body may further include a guide groove defined to be recessed in an elongated manner by a length of a movement section between the first location and the second location, and the guide may be formed such that the guide groove is at least partially inserted thereinto, and restrict the fixing body from moving beyond the movement section between the first location and the second location.

The mounting portion may be disposed at the rear of the laundry inlet, the mounting portion may be disposed to be detachable from the storage in a vertical direction, and the fixing body may move in a front and rear direction or in a left and right direction based on the laundry inlet.

When the fixing body moves rearward while the storage and the mounting portion are coupled to each other, the coupling of the storage and the mounting portion may be released.

The storage coupling portion may further include a grip protrusion protruding from the fixing body in a direction opposite to a protrusion direction of the fixing protrusion and exposed to the outside of the storage.

The laundry treating apparatus may further include a mounting coupling portion disposed on the mounting portion at a location corresponding to the storage coupling portion, wherein the mounting coupling portion includes a first fixing member capable of being coupled to the fixing protrusion as the fixing protrusion is being caught thereon, and the first fixing member may include a first inclined surface disposed to enable contact with the fixing protrusion when coupled with the storage coupling portion and disposed diagonally to be able to guide the fixing protrusion in a direction of the second location, and a fixing surface extending in a direction of the first location from one of both ends of the first inclined surface located at a lower vertical level.

When the storage coupling portion and the mounting coupling portion are coupled to each other, the fixing surface may be disposed upwardly of an upper end of the fixing protrusion and thus the fixing protrusion may be restricted from moving upward.

The fixing protrusion may move in the direction of the second location while being in contact with the first inclined surface when the storage is coupled to the mounting portion, and may be disposed under the fixing surface while moving in the direction of the first location and may be restricted from moving upward when an upper end of the fixing protrusion is located downwardly of the one end of the first inclined surface.

The fixing protrusion may include a first protruding surface disposed to be inclined diagonally to correspond to the first inclined surface, and a second protruding surface extending from one of both ends of the first protruding surface disposed at a higher vertical level in the direction of the second location and in surface contact with the fixing surface.

The mounting coupling portion may further include a second fixing member disposed closer to the second location than a location of the first fixing member to be in contact with the fixing body when the fixing body moves in the direction of the second location while the fixing protrusion is disposed under the fixing surface, wherein the second fixing member enables release of the coupling of the first fixing member and the fixing protrusion, and the second fixing member may include a second inclined surface disposed to be inclined in an opposite direction to the first inclined surface and configured to guide the fixing protrusion such that a lower end of the fixing protrusion is disposed upwardly of the fixing surface when the fixing body moves in the direction of the second location.

The second fixing member may further include a release surface extending in the direction of the second location from one of both ends of the second inclined surface disposed at a higher vertical level, wherein the release surface includes a stopping protrusion restricting the fixing protrusion from moving to the second inclined surface.

The release surface may be disposed upwardly of the one end of the second inclined surface and may be disposed downwardly of the fixing surface.

The storage protrusion may be at least partially inserted into the storage and may be restricted from moving upward when the fixing body is disposed at the first location, and may be able to be separated from the storage upward when the fixing body is disposed at the second location.

The fixing protrusion may move in the direction of the first location to be disposed under the fixing surface when being disposed on the second inclined surface, and may be restricted from moving in the direction of the first location by the stopping protrusion when being disposed on the released surface.

The storage may be detachably coupled to the mounting portion in the vertical direction, and the storage may be able to be separated from the mounting portion by being spaced apart therefrom when the fixing body moves in the direction of the second location while the storage is coupled to the mounting portion.

The laundry treating apparatus may further include a mounting receiving groove defined in the mounting portion to accommodate the storage protrusion therein, the storage protrusion may be constructed to discharge the detergent stored in the storage, and the mounting receiving groove may be constructed to deliver the detergent discharged from the storage protrusion to the tub.

The laundry treating apparatus may further include a detergent outlet spaced apart from the storage protrusion in the one direction and disposed between the storage coupling portion and the storage protrusion, wherein the detergent outlet protrudes downward from the storage so as to discharge the detergent, a mounting receiving groove defined in the mounting portion such that the storage protrusion is able to be inserted thereinto, and a detergent intake defined such that the detergent outlet is inserted thereinto, and delivering the detergent to the tub, and the detergent outlet may be inserted into the detergent intake such that the storage protrusion is able to be separated upward, and thus, may be restricted from moving in the one direction, wherein the detergent outlet may be at least partially inserted into the detergent intake and may be restricted from moving upward as the storage coupling portion and the mounting portion are coupled to each other.

Advantageous Effects

According to the present disclosure, the storage storing the detergent therein may be stably and detachably fixed at the location outside the cabinet while being exposed to the outside in the automatic detergent supply device of the top load-type washing machine.

According to the present disclosure, the storage in the top load-type washing machine may be fixed and separated outside of the cabinet in the vertical movement scheme, but may be able to remain fixed despite the vibration, the impact, and the like.

According to the present disclosure, the storage in the top load-type washing machine may be firmly coupled to the cabinet in the vertical movement scheme, but may be able to be easily separated depending on the intention of the user.

According to the present disclosure, there is the coupling structure that may maintain the state in which the storage is firmly mounted on the mounting portion even with the vibration or the like as the storage coupling portion is restricted from moving upward when the storage coupling portion is coupled to the mounting portion even when the storage protrusion is coupled to the mounting portion so as to be movable upward.

According to the present disclosure, even when the storage is detachably coupled to the cabinet in the vertical movement scheme in the top load-type washing machine, the storage is not arbitrarily separated as long as the fixing protrusion is disposed at the first location.

According to the present disclosure, the storage may be allowed to be separated upwardly from the mounting portion when the fixing protrusion is moved to the second location even when the storage is coupled to the mounting portion in the top load-type washing machine.

BRIEF DESCRIPTION OF THE DRAWINGS

FIG. 1 is a diagram showing an outer appearance of a laundry treating apparatus according to an embodiment of the present disclosure.

FIG. 2 is a cross-sectional view showing the interior of a laundry treating apparatus according to an embodiment of the present disclosure.

FIG. 3 is a diagram showing a storage mounted on a mounting portion in an embodiment of the present disclosure.

FIG. 4 is a diagram showing a storage detachable from a mounting portion in a height direction in an embodiment of the present disclosure.

FIG. 5 is a diagram showing a mounting portion according to an embodiment of the present disclosure.

FIG. 6 is a diagram showing a mounting coupling portion according to an embodiment of the present disclosure.

FIG. 7 is a perspective view of a storage according to an embodiment of the present disclosure.

FIG. 8 is an exploded perspective view of a storage according to an embodiment of the present disclosure.

(a) in FIG. 9 is a perspective view of a fixing body according to an embodiment of the present disclosure viewed from one direction, and (b) in FIG. 9 is a perspective view of a fixing body according to an embodiment of the present disclosure viewed from another direction.

FIG. 10 is a diagram showing a fixing body installed on a storage body according to an embodiment of the present disclosure.

FIG. 11 is a view showing a storage mounted on a mounting portion according to an embodiment of the present disclosure.

(a) in FIG. 12 is a diagram showing a storage being coupled to a mounting portion, and (b) in FIG. 12 is a diagram showing a storage coupled to a mounting portion.

(a) in FIG. 13 is a diagram showing a storage and a mounting portion before being coupled to each other, and (b) in FIG. 13 is a diagram showing locations of a fixing protrusion and a mounting coupling portion in (a) in FIG. 13.

(a) in FIG. 14 is a diagram showing a storage and a mounting portion being coupled to each other, and (b) in FIG. 14 is a diagram showing locations of a fixing protrusion and a mounting coupling portion in (a) in FIG. 14.

(a) in FIG. 15 is a drawing showing a storage and a mounting portion coupled to each other, and (b) in FIG. 15 is a diagram showing locations of a fixing protrusion and a mounting coupling portion in (a) in FIG. 15.

(a) in FIG. 16 is a diagram showing a storage coupled to a mounting portion, and (b) in FIG. 16 is a diagram showing a storage being separated from a mounting portion.

(a) in FIG. 17 shows a storage and a mounting portion being separated from each other as a mounting body moves to a second location, and (b) in FIG. 17 is a diagram showing locations of a fixing protrusion and a mounting coupling portion in (a) in FIG. 17.

(a) in FIG. 18 shows a storage and a mounting portion separated from each other as a mounting body moves to a second location, and (b) in FIG. 18 is a diagram showing locations of a fixing protrusion and a mounting coupling portion in (a) in FIG. 17.

FIGS. 19 to 21 show a fixing body according to another embodiment of the present disclosure.

DETAILED DESCRIPTION

Hereinafter, an embodiment of the present disclosure will be described in detail with reference to the accompanying drawings such that a person having ordinary knowledge in the technical field to which the present disclosure belongs may easily implement the embodiment.

However, the present disclosure is able to be implemented in various different forms and is not limited to the embodiment described herein. In addition, to clearly describe the present disclosure, components irrelevant to the description are omitted in the drawings. Further, similar reference numerals are assigned to similar components throughout the present document.

Duplicate descriptions of the same components are omitted herein.

In addition, it will be understood that when a component is referred to as being 'connected to' or 'coupled to' another component herein, it may be directly connected to or coupled to the other component, or one or more intervening components may be present. On the other hand, it will be understood that when a component is referred to as being 'directly connected to' or 'directly coupled to' another component herein, there are no other intervening components.

Furthermore, the terminology used herein is for the purpose of describing the specific embodiment of the present disclosure only and is not intended to be limiting of the present disclosure.

As used herein, the singular forms 'a' and 'an' are intended to include the plural forms as well, unless the context clearly indicates otherwise.

It should be understood that the terms 'comprises', 'comprising', 'includes', and 'including' when used herein, specify the presence of the features, numbers, steps, operations, components, parts, or combinations thereof described herein, but do not preclude the presence or addition of one or more other features, numbers, steps, operations, components, or combinations thereof.

In addition, herein, the term 'and/or' includes a combination of a plurality of listed items or any of the plurality of listed items. Herein, 'A or B' may include 'A', 'B', or 'both A and B'. FIG. 1 shows an embodiment of a structure of a laundry treating apparatus of the present disclosure.

FIG. 1 is a diagram showing an outer appearance of a laundry treating apparatus according to an embodiment of the present disclosure.

As shown in FIG. 1, a laundry treating apparatus 100 includes a cabinet 1 and a treating portion defined inside the cabinet to provide a space where laundry is received.

The cabinet 1 may include a housing 11 that provides a space where the treating portion is received, and a top cover 12 that closes an open top surface of the housing.

The top cover 12 may have a cover body 121 fixed to the housing 11 to form a top surface of the laundry treating apparatus, and a laundry inlet 124 defined to extend through the cover body 121. The laundry inlet 124 may be closed by a door 13 pivotably coupled to the cover body 121.

The top cover 12 may have a front space (a first space) 122 located in front of the laundry inlet 124, and a rear space (a second space) 123 located at the rear of the laundry inlet 124. The front space 122 may have a control panel 125, and the control panel 125 may include an input unit 126 that receives a control command from the user, and a display 127 that displays information related to the laundry treating apparatus.

FIG. 2 is a cross-sectional view showing the interior of a laundry treating apparatus according to an embodiment of the present disclosure.

As shown in FIG. 2, the treating portion includes a tub 2 in which water is stored, and a drum 3 disposed inside the tub and storing an object to be washed (laundry or the like) supplied through the laundry inlet 124.

Because the tub 2 must be in a structure capable of storing water, the tub 2 may be formed as a hollow cylindrical tub body 21.

The tub body 21 is fixed to the cabinet 1 via a tub support 23. One end of the tub support 23 may be fixed to the cover 12 or the housing 11 and the other end thereof may be formed as a bar fixed to a circumferential surface of the tub body 21. A tub inlet 22 located below the laundry inlet 124 is defined in a top surface of the tub body 21.

The tub body 21 may receive water via a water supply S, and water inside the tub body 21 may be discharged to the outside of the cabinet 1 via a drain 25.

The water supply S may include a water supply pipe 4 connected to a water supply source, a water supply valve 5 that controls opening and closing of the water supply pipe 4 in response to a control signal from a controller (a first controller), and a water supply flow channel 6 that guides water supplied from the water supply pipe 4 into the tub 2. FIG. 2 shows a case in which the water supply flow channel 6 guides water into the tub body 21 via the tub inlet 22 as an example.

The drain 25 may include a drain pipe 251 that guides water inside the tub body 21 to the outside of the cabinet 1, and a drain valve 252 that controls opening and closing of the drain pipe in response to a control signal of the first controller.

The drum 3 is means that is located inside the tub body 21 and provides a space for storing the laundry. The drum 3 may be formed as a hollow cylindrical drum body 31.

A drum inlet 32 located below the tub inlet 22 may be defined in a top surface of the drum body 31. Accordingly, the user may put the laundry into the drum body 31 via the laundry inlet 124, the tub inlet 22, and the drum inlet 32. Communication holes 33 that allow the tub body 21 and an inner space of the drum body 31 to be in communication with each other may be defined in a circumferential surface, a bottom surface, and the like of the drum body 31.

A stirrer 34 that is rotatably disposed inside the drum body and is able to form a water flow inside the drum body 31 may further be disposed on the bottom surface of the drum body 31.

The drum body 31 and the stirrer 34 may be rotated by a driver. The driver includes a motor 35 fixed to a bottom of the tub body 21 and located outside the tub body 21, a drum shaft 36 that connects the motor with the drum body 31, and a stirring shaft 37 that connects the motor with the stirrer 34.

The stirring shaft 37 may extend through the drum shaft 36 and directly connect a rotor of the motor 35 with the stirrer 34. In this case, a gear 38 that connects the stirring shaft 37 with the drum shaft 36 and a clutch 39 that controls connection between one end of the drum shaft 36 and the rotor may be disposed inside the drum shaft 36.

As shown in FIG. 3, the laundry treating apparatus 100 may include a detergent supply 18 and 8 for supplying detergent to the tub 2.

The detergent supply may include a first supply (a manual detergent supply) 18 that receives the detergent from the user and supplies the detergent to the tub 2, and a second supply (an automatic detergent supply or storage) 8 that may supply an appropriate amount of detergent to the tub 2 at a set time point under control of the first controller.

The first supply 18 may be formed as a drawer box that may be extended from the water supply flow channel 6 defined in the top cover 12. The drawer box may be constructed to be extended from the top cover 12 along a direction (a+X-axis direction) in which a center of the laundry inlet 124 is located from the water supply flow channel 6. The user may extend the first supply 18 from the top cover 12, put the detergent into the drawer box, and then push the first supply 18 in a direction toward a rear portion of the top cover 12 (a−X-axis direction) to load the first supply 18 in the top cover 12.

The first supply 18 is in communication with the water supply flow channel 6 to receive water from the water supply flow channel, and is in communication with the tub 2 via a first drain flow channel. That is, when water introduced via the water supply flow channel 6 flows into the first supply 18, the detergent loaded in the drawer box may be mixed with water and be discharged into the tub 2 via a first discharge flow channel.

The second supply (the storage) 8 may be detachably coupled to a mounting portion 7 disposed on the top cover 12. The second supply 8 includes a storage body 81 in which the detergent is stored. The storage body 81 is disposed such that at least one surface thereof is exposed to the outside, so that the user may supply the detergent or view an amount of stored detergent via the exposed one surface.

Because the second supply 8 is located at an upper portion of the mounting portion, the detergent may be automatically supplied to the second supply 8 by gravity without a separate pump. In addition, as described above, the second supply 8 may supply a needed amount of the detergent at a needed time to the mounting portion 7 by the controller.

The mounting portion 7 may be in communication with the water supply flow channel 6 to receive water. Additionally, the mounting portion 7 may be in communication with the tub 2 via a second discharge flow channel to deliver the detergent or water introduced via the second supply 8 or the water supply flow channel 6 to the tub. The second discharge flow channel may form a flow channel separate from the first discharge flow channel for smooth drainage, but the present disclosure is not necessarily limited thereto.

That is, when the second supply 8 is mounted on the mounting portion 7, the detergent stored in the storage body 81 may be discharged to the mounting portion 7. The detergent discharged to the mounting portion 7 may be discharged into the tub 2 via the second discharge flow channel.

When the detergent stored in the storage body 81 of the second supply 8 is liquid detergent, without additional water from the water supply flow channel 6, the detergent may flow from the storage body 81 to the mounting portion 7 on its own and then again from the mounting portion 7 to the tub 2. Therefore, it is preferable that the detergent stored in the storage body 81 is the liquid detergent.

In one example, first detergent may be stored in the first supply 18 and second detergent may be stored in the second supply 8. When water is introduced via the water supply flow channel 6, the first detergent and the second detergent may be mixed with water and discharged into the tub 2. The first detergent and the second detergent discharged into the tub 2 may be mixed with each other to form washing liquid in the tub 2.

FIG. 4 is a diagram showing a first storage in which a storage body is detachable in a height direction in an embodiment of the present disclosure.

As shown in FIG. 4, the second supply (the storage) 8 is detachable from the mounting portion 7 in a vertical direction (a Y-axis direction) based on the top cover 12 or the laundry inlet 124.

As the storage 8 is detachable in the vertical direction of the mounting portion 7, a detachment structure of the storage 8 and the mounting portion 7 and a flow path of the detergent leading from the storage 8 to the tub 2 may be simplified.

The mounting portion 7 is disposed at the rear of the laundry inlet 124, and the storage (the second supply) 8 is also able to be coupled to the mounting portion 7 or separated from the mounting portion at the rear of the laundry inlet 124.

A specific structure in which the mounting portion 7 and the storage 8 are coupled to or separated from each other will be described later.

As described above, the storage 8 includes the storage body 81 in which the detergent is stored and a storage coupling portion 83 that may be coupled to a mounting coupling portion 73 to be described later. When the storage body 81 is coupled to the mounting portion 7, at least one surface of the storage body 81 may be exposed to the outside.

The storage body 81 may include a seating surface 811 that forms a bottom surface of the storage body 81 and is seated on a support surface 711 of the mounting portion 7, which will be described later, a detergent inlet 813 defined in one exposed surface of the storage body 81 to allow the detergent to be injected, and a detergent outlet 815 defined in the seating surface 811 (the bottom surface of the storage body 81) to allow the detergent stored inside the storage body 81 to be discharged downward.

The storage coupling portion 83 may be formed on at least one surface of the storage body 81 and may be detachably coupled to the mounting coupling portion 73. As will be described later, the storage coupling portion 83 is preferably disposed to be exposed to the outside of the storage body 81 because the user must be able to visually recognize and manipulate the same. Specifically, the storage coupling portion 83 may be preferably formed on one surface of the storage body 81 excluding the detergent inlet 813 and the detergent outlet 815. The drawing shows that the storage coupling portion 83 is formed on a side surface of the storage body 81.

The mounting portion 7 includes a mounting body 71 that provides a space where the storage body 81 is mounted, and the mounting coupling portion 73 that may be coupled to the storage coupling portion 83.

At least one surface of the mounting body 71 may be exposed to the outside to provide a surface on which the storage body 81 is seated. Specifically, the mounting body 71 may include the support surface 711 that forms a top surface of the mounting body 71 and supports the bottom surface (the seating surface) 811 of the storage body 81.

In addition, the mounting body 71 may further include a detergent intake 715 defined in the top surface (the support surface) 711 of the mounting body 71.

When the detergent outlet 815 of the storage 8 is formed in a shape of being recessed from the storage body 81, the detergent intake 715 may be formed in a shape of protruding upward to be inserted into the detergent outlet 815. When the detergent outlet 815 of the storage 8 is formed in a shape of protruding downward, the detergent intake 715 may be defined to be recessed from the mounting body 71 to accommodate the detergent outlet 815 therein. In this regard, to discharge the detergent to the mounting portion by a detergent storage amount of the storage body 81 and a self-weight thereof, it is preferable that the detergent outlet 815 is formed in the shape protruding downward and the detergent intake 715 is defined in a shape of a groove that may accommodate the detergent outlet 815 therein.

In addition, when the detergent intake 715 is defined in the shape of being recessed from the support surface 711 of the mounting body 71, the detergent intake 715 may include an intake protrusion that protrudes upward and is able to be inserted into the detergent outlet 815 and an intake hole that is defined in the intake protrusion to allow the inflow of the detergent.

Specifically, to prevent excessive supply of the detergent to the mounting portion 7, the detergent intake 715 may be defined in the recessed shape to allow the detergent outlet 815 to be inserted thereinto, and may include an intake protrusion 7151 protruding upward from a bottom surface of the detergent intake 715, and the intake hole defined in the intake protrusion 7151. In this case, the detergent discharged from the detergent outlet 815 of the storage 8 may be filled from the bottom surface of the detergent intake 715 and then flow to the tub 2 via the intake hole. That is, at this time, the detergent intake 715 may function as a trap to prevent the detergent discharged from the detergent outlet 815 from being suddenly introduced excessively.

In one example, the storage body 81 may be composed of a first storage body 81*a*and a second storage body 81*b*, and the mounting body 71 may be composed of a first mounting body 71*a* disposed at one side in a width direction (the Y-axis direction) and a second mounting body 71*b* disposed at the other side in the width direction. The first storage body 81*a* may be mounted on the first mounting body 71*a* and the second storage body 81*b* may be mounted on the second mounting body 71*b*. That is, the first storage body 81*a* and the second storage body 81*b* may be detachable at one side and the other side of the mounting portion in the vertical direction.

The drawing is only an example of the case in which there are two mounting bodies 71 and two storage bodies 81, and the present disclosure is not necessarily limited thereto.

FIG. 5 is a diagram showing a mounting portion according to an embodiment of the present disclosure.

As shown in FIG. 5, the mounting portion 7 includes the mounting body 71 and the mounting coupling portion 73. Because this has been described above, a redundant description will be omitted.

The detergent intake 715 may be defined to be recessed downward from the support surface 711 of the mounting body 71 such that the detergent outlet 815 may be inserted thereinto.

The support surface 711 of the mounting body 71 may further include a mounting receiving groove 75 defined to be recessed such that a storage protrusion 85 of the storage 8, which will be described later, may be inserted thereinto. As the storage protrusion 85 is received in the mounting receiving groove 75, a movement of the storage body 81 (in the X-axis direction and the Y-axis direction) may be restricted. That is, the mounting receiving groove 75 may be defined to be recessed in the mounting body 71 to prevent the detergent outlet 815 from being broken and to ensure that the storage 8 is stably seated when the mounting portion 7 is inserted.

The mounting coupling portion 73 may be spaced apart from the mounting receiving groove 75 in one direction among directions parallel to the ground (the X-axis direction and the Y-axis direction) and may be coupled to the storage coupling portion 83.

Additionally, the mounting coupling portion 73 is preferably formed on one of the surfaces exposed to the outside rather than the support surface 711. This is because, when the mounting coupling portion 73 is formed on the support surface 711, the seating of the storage body 81 on the mounting body 71 may be hindered. The mounting coupling portion 73 may be formed to protrude from one side surface in the width direction (the Y-axis direction) of the mounting body 71. In the drawing, the mounting coupling portion 73 is shown to be formed on the side surface of the mounting body 71, but the mounting coupling portion 73 may also be formed on a front surface or a rear surface of the mounting body 71.

FIG. 6 is a diagram showing a mounting coupling portion according to an embodiment of the present disclosure, and is an enlarged view of a portion A in FIG. 5.

As shown in FIG. 6, the mounting coupling portion 73 may include a first mounting member 731 and a second mounting member 732 disposed adjacent to the first mounting member 731 that are disposed on the mounting body 71.

In one example, as will be described later, a fixing protrusion 833 of the storage coupling portion 83 may be movable in the direction parallel to the ground, and may be coupled to the first mounting member 731 by being disposed at a first location. Additionally, the fixing protrusion 833 is disengaged from the first mounting member 731 and is seated on the second mounting member 732 by being disposed at a second location.

That is, the first mounting member 731 is disposed closer to the first location than the second mounting member 732, and the second mounting member 732 is disposed closer to the second location than the first mounting member 731. In other words, the first mounting member 731 is disposed in a direction of the first location in the mounting coupling portion 73 and the second mounting member 732 is disposed in a direction of the second location in the mounting coupling portion 73. The first location and the second location, and a specific coupling structure will be described later.

The first mounting member 731 includes a first inclined surface 731*a* that is diagonally disposed such that when the storage coupling portion 83 and the mounting coupling portion 73 are coupled to each other, the fixing protrusion 833, which will be described later, of the storage coupling portion 83 is in contact therewith and is guided in the direction of the second location, and a fixing surface 731*b* extending in the direction of the first location from one end disposed at a lower vertical level of both ends of the first inclined surface 731*a*.

Because the first inclined surface 731*a* is disposed to be inclined downward in the direction of the second location, when the storage 8 is coupled to the mounting portion 7 (when the storage body 81 moves downward and is coupled to the mounting portion), the fixing protrusion 833 may be guided in the direction of the second location.

The fixing surface 731*b* is formed as a surface extending from the one end disposed at the lower vertical level of the first inclined surface 731*a* in the direction of the first location. As described above, when the storage 8 is mounted on the mounting portion 7, the fixing protrusion 833, which has moved in the direction of the second location, may be moved again in the direction of the first location by an elastic portion to be described later. In this regard, a top surface of the fixing protrusion 833 is caught by the fixing surface 731*b* and the fixing protrusion 833 is restricted from moving upward.

Additionally, an extending surface 731*c* protruding downward from one end close to the first location of the fixing surface 731*b* may be further included. The extending surface 731*c* may function as a stopper that may restrict the fixing protrusion 833 from moving in the direction of the first location. As shown in the drawing, when the mounting coupling portion 73 protrudes from a surface parallel to the ground (preferably the side surface) of the mounting body 71, the extending surface 731*c* protrudes from a bottom of the fixing surface 731*b*. As another example, when, unlike the drawing, the mounting coupling portion 73 protrudes upward from the mounting body 71, the extending surface 731*c* may separate the fixing surface 731*b* from the mounting body 71 to determine a vertical level of the fixing surface 731*b*.

The second mounting member 732 includes a second inclined surface 732*a* disposed to be inclined upward along the direction of the second location so as to guide the fixing protrusion 833 upward when the fixing protrusion 833 moves from the first location in the direction of the second location. In addition, the second mounting member 732 further includes a release surface 732*b* extending from one end disposed at a higher vertical level of the second inclined surface 732*a* in the direction of the second location, and a stopping protrusion 732*c* disposed at one end of the release surface 732*b* adjacent to one end of the second inclined surface 732*a*.

The second inclined surface 732*a* may be disposed in a form inclined upward in the direction of the second location so as to guide the fixing protrusion 833 upward when a fixing body 831 moves in the direction of the second location.

The other end disposed at a lower vertical level of the second inclined surface 732*a* is disposed downwardly of the fixing surface 731*b*, and allows the fixing protrusion to move along the second inclined surface 732*a* while moving in the direction of the second location at a location below the fixing surface 731*b*. In addition, as one end disposed at a higher vertical level of the second inclined surface 732*a* is disposed downwardly of the fixing surface 731*b*, the fixing body 831 (or the fixing protrusion 833) may move from the second location back to the first location (under the fixing surface 731*b*).

The release surface 732*b* extends from the end of the second inclined surface 732*a* to the second location. The release surface 732*b* is disposed closer to the second location than the second inclined surface 732*a*. When located on the release surface 732*b*, the fixing protrusion 833 is released from the fixing surface 731*b* and thus is able to move upward.

Additionally, the release surface 732*b* has the stopping protrusion 732*c* at a point where it meets the one end of the second inclined surface 732*a*. When the fixing body 831 is disposed at the second location, that is, once the fixing protrusion 833 is located on the release surface 732*b* beyond the stopping protrusion, the stopping protrusion 732*c* may restrict the fixing protrusion 833 from moving in the direction of the first location, that is, toward the second inclined surface 732*a*. Accordingly, once the fixing body 831 is disposed at the first location (once the fixing protrusion 833 is located on the release surface 732*b* beyond the stopping protrusion 732*c*), the storage coupling portion 83 and the mounting coupling portion 73 may be remained disengaged from each other. In such state, the storage coupling portion 83 of the storage 8 is disengaged and only the insertion of the storage protrusion 85 is performed, so that the user may lift the storage body 81 upward and easily remove the storage 8 from the mounting portion 7.

Additionally, the second mounting member 732 may include a guide surface 732*d* extending in the direction of the first location from the other end disposed at a bottom of the second inclined surface 732*a*. When the second inclined surface 732*a* is to move the storage body 81 upward while the fixing protrusion moves to the second location, the guide surface 732*d* is to allow the fixing protrusion to be stably guided to the second inclined surface 732*a* while moving to the second location.

The mounting coupling portion 73 protrudes from the mounting body 71, and the storage coupling portion 83 protrudes from the storage body. As long as the mounting coupling portion is able to be coupled to the storage coupling portion 83 on the mounting portion 7, a specific location of the mounting coupling portion is not limited. For example, the mounting coupling portion 73 may protrude from the side surface of the mounting body 71 parallel to the ground. In this case, the storage coupling portion 83 may also protrude toward the inside of the storage body 81 at a corresponding location so as to be coupled to the mounting coupling portion. Specifically, as shown in the drawing, the mounting coupling portion 73 may protrude from the side surface of the mounting body 71 in the width direction. In this case, the storage coupling portion 83 may protrude inward from the side surface of the storage body 81 in the width direction and be coupled to the mounting coupling portion 73.

As another example, the mounting coupling portion 73 may protrude upward from the mounting body 71, and the storage coupling portion 83 may be formed in a shape of protruding downward from the storage body 81.

A specific mounting and separating process between the fixing protrusion 833, the first mounting member 731, and the second mounting member 732 will be described later.

FIG. 7 is a perspective view of a storage according to an embodiment of the present disclosure, and FIG. 8 is an exploded perspective view of a storage according to an embodiment of the present disclosure.

Referring to FIGS. 7 and 8 together, the storage 8 includes the storage body 81 that provides the space for storing the detergent, the storage coupling portion 83 that is disposed on one surface of the storage body 81 and is detachable from the mounting coupling portion 73, and the storage protrusion 85 that protrudes downward from the bottom surface of the storage body 81.

The detergent inlet 813 through which the detergent may be injected is defined in one exposed surface of the storage body 81. The detergent outlet 815 that may be in communication with the detergent intake 715 is disposed on the bottom surface of the storage body 81 or the seating surface 811. As described above, the detergent outlet 815 may be accommodated in the detergent intake 715.

In addition, the storage 8 further includes a storage cover 82 that includes a detergent cover 821 that is pivotably disposed on the storage body 81 and opens and closes the detergent inlet 813, and a coupling cover 823 that surrounds the side surface of the storage body 81 to which the mounting coupling portion 73 is coupled such that the fixing body of the mounting coupling portion is exposed.

The storage body 81 further includes an installation portion 817 that provides a space for the storage coupling portion 83 to be installed in the storage body 81. The storage coupling portion 83 may be installed on the installation portion 817 and installed on the storage body 81.

The storage body 81 includes the detergent inlet 813 into which the detergent may be injected. The detergent inlet 813 may be preferably defined in one surface of the storage body 81 opposite to the seating surface 811, and more preferably, defined in the top surface of the storage body 81 to inject the detergent while the storage 8 is mounted on the mounting portion 7.

The storage cover 82 may include the detergent cover 821 pivotably coupled to the storage body to open and close the detergent inlet 813, and the coupling cover 823 surrounding the storage coupling portion 83 to expose at least a portion of the storage coupling portion 83.

The detergent cover 821 may be pivotable about a hinge shaft and open and close the detergent inlet 813. The user may easily inject the detergent into the storage body 81 via the detergent inlet 813 by opening only the detergent cover 821 when the storage body 81 is seated on the mounting body 71.

The coupling cover 823 may cover the storage coupling portion 83 such that at least a portion of the storage coupling portion 83 is exposed, and preferably, a grip protrusion 837 to be described later that may be gripped by the user is exposed to the outside. The coupling cover 823 has a long cover slit 8231 defined therein to guide the grip protrusion 837 between the first location and the second location. The user may grip or push the grip protrusion 837 exposed via the cover slit 8231 with a hand thereof, so that the fixing body 831 connected to the grip protrusion 837 may stably move between the first location and the second location.

Additionally, the storage 8 may further include the storage protrusion 85 protruding downward from the bottom surface (the seating surface) 811 of the storage body 81. As described above, the storage protrusion 85 may be inserted into and accommodated in the mounting receiving groove 75. That is, when the storage 8 is mounted on the mounting portion 7 and the storage protrusion 85 is inserted into the mounting receiving groove 75, the storage protrusion 85 is supported by the mounting receiving groove 75 in the direction parallel to the ground (the X-axis direction and the Y-axis direction). That is, the storage protrusion 85 is inserted into the mounting receiving groove 75 such that the storage body 81 is supported in the X-axis direction and the Y-axis direction. However, when the storage 8 and the mounting portion 7 are coupled to each other, the storage protrusion 85 is restricted from moving upward by the storage coupling portion 83. This will be described later.

The storage coupling portion 83 may be disposed at one side of the storage body 81. A specific structure of the storage coupling portion 83 will be described later.

(a) in FIG. 9 is a perspective view of a fixing body according to an embodiment of the present disclosure viewed from one direction, and (b) in FIG. 9 is a perspective view of a fixing body according to an embodiment of the present disclosure viewed from another direction.

As shown in (a) and (b) in FIG. 9, the storage coupling portion 83 includes the fixing body 831 that forms a main body, the fixing protrusion 833 that protrudes from one surface of the fixing body facing the storage body 81, an elastic portion 835 disposed on one side of the fixing body 831, and the grip protrusion 837 that protrudes from the storage body 81 toward an opposite surface of the surface on which the fixing protrusion 833 is formed.

The fixing body 831 may form the main body of the storage coupling portion 83 and may support the fixing protrusion 833, the elastic portion 835, and the grip protrusion 837. A guide groove 831*a* that may receive an installation protrusion 817*a* of the installation portion 817, which will be described later, may be defined in the fixing body 831. The guide groove 831*a*extends in the direction of the first location and the direction of the second location. As the installation protrusion 817*a* is inserted into the guide groove 831*a*, the fixing body 831 may stably move between the first location and the second location.

The fixing protrusion 833 protrudes from the fixing body 831 on an installation surface 8171 of the installation portion 817 to be described later or on the surface facing the mounting coupling portion 73. The fixing protrusion 833 is coupled by being caught on the fixing surface 731*b* of the first mounting member 731, and is restricted from moving upward. The fixing protrusion 833 may be released from the coupling with the first mounting member 731 by being disposed on the release surface 732*b* of the second mounting member 732. The specific coupling and separation of the fixing protrusion 833 will be described later.

The elastic portion 835 may extend from the fixing body 831. The elastic portion 835 may extend from one side closer to the second location among both sides of the fixing body 831 in the direction of the second location. The elastic portion 835 may provide a force in the direction of the first location to the fixing body 831 while being supported by a second restricting surface 8175 of the installation portion 817, which will be described later. Therefore, in a free state in which no force is applied, the fixing body 831 is disposed at the first location while touching a first restricting surface 8173, which will be described later.

Additionally, an elastic protrusion 835*a* that protrudes in the direction of the second location is disposed at a free end of the elastic portion 835. The elastic protrusion 835*a* is inserted into an elastic hole 8175*a* of the installation portion 817, which will be described later, so that the free end of the elastic portion 835 may be supported on the second restricting surface 8175, which will be described later.

The grip protrusion 837 may protrude from the fixing body 831 on the surface opposite to the surface on which the fixing protrusion 833 is formed. The grip protrusion 837 may be exposed to the outside of the storage 8 such that the user may directly grip the grip protrusion 837 with the hand thereof and provide a force to the fixing body 831. The user may move the fixing body 831 to the second location by gripping the grip protrusion 837. Additionally, the user may visually perceive the mounting state of the mounting coupling portion 73 via the grip protrusion 837 exposed from the storage 8.

FIG. 10 is a diagram showing a fixing body installed on a storage body according to an embodiment of the present disclosure.

Referring to FIG. 10, the storage coupling portion 83 may be installed by being seated on the installation portion 817 of the storage body 81.

The installation portion 817 is coupled to the storage body 81 to provide a space where the storage coupling portion 83 may be installed. The fixing body 831 may be coupled to the storage body 81 via the installation portion 817 so as to move to the first location and the second location.

The installation portion 817 includes the installation surface 8171 that provides a space on which the fixing body 831 is seated, the first restricting surface 8173 that protrudes from one side (meaning the direction of the first location) of the installation surface 8171 and restricts the movement of the fixing body, and a second restricting surface 8175 that protrudes from the other side (meaning the direction of the second location) of the installation surface 8171 and has the elastic hole 8175*a* into which one end of the elastic portion, which will be described later, may be inserted.

Here, installation means coupling the fixing body 831 and the storage body 81 to each other such that the fixing body may move between the first location and the second location.

The installation surface 8171 may have a guide slit 8171*a* defined therein such that the fixing protrusion 833 may be inserted thereinto and move in the direction of the first location and the direction of the second location. When the fixing protrusion is inserted thereinto, the guide slit 8171*a* may guide a translational movement of the fixing protrusion to the first location and the second location, and may be defined to be elongated along the direction of the first location and the direction of the second location to restrict the upward or downward movement. That is, the fixing protrusion 833 may be exposed toward the mounting coupling portion 73 via the guide slit 8171*a* of the installation surface 8171, thereby being engaged with the mounting coupling portion 73.

The first restricting surface 8173 may restrict the movement of the fixing body 831 such that the fixing body is fixed at the first location. That is, when one surface of the fixing body 831 close to the first location touches the first restricting surface 8173, the fixing body 831 may be considered to be located at the first location.

The second restricting surface 8175 may have the elastic hole 8175*a* into which at least a portion of the elastic portion 835, specifically the elastic protrusion 835*a*, may be inserted, and the elastic hole 8175*a* may support the fixing body 831 at the second location.

The installation portion 817 may have the installation protrusion 817*a* whose at least one surface is inserted into the guide groove 831*a*, which will be described later. The installation protrusion 817*a* guides the movement of the fixing body 831 while being engaged with the guide groove 831*a*. That is, the installation protrusion 817*a* may restrict the fixing body 831 to move only between the first location and the second location. With such structure, the fixing body 831 may be guided in the direction of the first location and in the direction of the second location, and the upward or downward (the Z-axis direction) movement of the fixing body 831 may be restricted.

The first location refers to a location on one side where the fixing body 831 is supported by the first restricting surface 8173, the installation protrusion 817*a*, or the first mounting member 731, and the second location is a location in a direction opposite to the first location, and refers to a location where the fixing body 831 is supported by the second restricting surface 8175 or the installation protrusion 817*a* or a location on the other side where the fixing protrusion 833 is disposed on the release surface 732*b*. With such structure, the fixing body 831 may perform the translational movement between the first location and the second location.

In other words, the first location refers to a state in which the mounting coupling portion and the storage coupling portion are able to be coupled to each other or are coupled to each other, and thus, is able to be defined as a coupling location. The second location may be defined as a separation location because the fixing body 831 may be located at the second location only when the mounting coupling portion and the storage coupling portion are separated from each other.

FIG. 11 is a view showing a storage mounted on a mounting portion according to an embodiment of the present disclosure, and FIG. 12 is an enlarged view of only a storage and a mounting portion in FIG. 11.

As shown in FIGS. 11 and 12, when the storage 8 is coupled to the mounting portion 7, the storage body 81 is seated on one surface (the support surface) 711 of the mounting body 71, the storage coupling portion 83 is coupled to the mounting coupling portion 73, and the storage protrusion 85 is inserted into the mounting receiving groove 75. In one example, as shown in the drawing, to improve a detergent storage amount of the storage body and to allow the storage body to be more firmly seated on the mounting body, the detergent outlet 815 may protrude downward from the storage body 81 and be inserted into detergent intake 715 of the mounting portion 7.

With the storage 8 coupled to the mounting portion 7, the movement of the storage body 81 in the direction parallel to the ground (the X-axis direction and the Y-axis direction) is restricted by the mounting receiving groove 75 into which the storage protrusion 85 is inserted. Additionally, the movement in any direction parallel to the ground is restricted by the coupling of the fixing protrusion 833 and the first mounting member 731. In addition, the upward (the +Z axis direction) movement of the storage body 81 is restricted by the mounting coupling portion 73 coupled with the storage coupling portion 83 (specifically, the fixing protrusion 833 and the fixing surface 731*b* of the first mounting member 731).

As such, when the storage 8 is coupled to the mounting portion 7, only the storage coupling portion 83 restricts a force in the upward direction (the +Z-axis direction). At this time, when the user applies the upward force to the storage body 81 or when an upward vibration or impact is applied to the storage body 81, a moment may occur in the storage body 81 centered on the storage coupling portion 83. This is because the storage coupling portion 83 is formed only on one surface of the storage body 81. When the moment occurring in the storage body 81 is not restricted, the storage coupling portion 83 or the mounting coupling portion 73 may be broken because of the moment.

To support the moment, it is preferable that the storage coupling portions 83 are formed at one side and the other side of the storage body 81, respectively. However, in such case, when the storage body 81 includes the plurality of storage bodies that are the first storage bodies 81*a* and the second storage bodies 81*b*, it may be difficult for the user to access the storage coupling portion 83 because of interference by the adjacent storage body. Additionally, when the storage coupling portion 83 is disposed at a front side and a rear side of the storage body 81, it may be difficult for the user to access the storage coupling portion 83 disposed at the rear side of the storage body 81. Therefore, a structure that may support the moment while forming the storage coupling portion 83 on only one surface of the storage body 81 is needed.

To this end, as described above, the storage 8 of the present disclosure includes the storage coupling portion 83 disposed on the storage body 81 and the storage protrusion 85 protruding downward from the bottom surface of the storage body 81, and the storage coupling portion 83 is formed on the storage body 81 to be spaced apart from the storage protrusion 85 in one direction parallel to the ground.

With such structure, the storage protrusion 85, which is spaced apart from the storage coupling portion 83 in the other direction opposite to the one direction, may be inserted into the mounting receiving groove 75 to support a pivoting moment occurring centered on the storage coupling portion 83.

When the storage protrusion 85 and the one storage coupling portion 83 are disposed as described above, while only one storage coupling portion 83 that provides a force to restrict the direct upward movement is disposed, the storage body 81 may be restricted from being lifted upward without the pivoting by the moment.

In this regard, the storage protrusion 85 is originally mounted in the mounting receiving groove 75 so as to be movable upward, but may be restricted from moving upward by a moment offset force of the storage coupling portion 83. In other words, the storage protrusion 85 is inserted into the mounting receiving groove 75 so as to be separable upward, but the upward movement thereof may be restricted by the coupling of the storage coupling portion 83 and the mounting coupling portion 73.

With such structure, the present disclosure may stably couple the storage 8 to the mounting portion 7 only with a simple structure of the storage protrusion 85 that restricts the movement in the direction parallel to the ground (the X-axis direction and the Y-axis direction), and the storage coupling portion 83 that is spaced apart from the storage protrusion 85 in the one direction and restricts the upward (the +Z-axis direction) movement.

In other words, the present disclosure may stably and firmly couple the storage 8 to the mounting portion 7 without applying vibration or impact caused by the moment force to the storage body 81 using one storage coupling portion and the structure of the storage protrusion.

Additionally, when the storage protrusion 85 is inserted into the mounting receiving groove 75, a gap therebetween needs to be minimized such that a movement of the storage protrusion 85 in a width direction is minimized. Accordingly, the storage protrusion 85 and the mounting receiving groove 75 may have area sizes corresponding to each other. That is, when the storage protrusion 85 is inserted into the mounting receiving groove 75, the movement thereof in the direction parallel to the ground (or a direction parallel to the support surface 711 of the mounting body 71) is restricted, thereby minimizing vibration. Additionally, the storage protrusion 85 may be more effectively restricted from being lifted upward by the storage coupling portion 83. When the storage protrusion 85 is inserted into the mounting receiving groove 75 again, a surface parallel to the ground of the storage protrusion 85 may come into contact with an inner peripheral surface of the mounting receiving groove 75.

In the drawing, the detergent outlet 815 and the storage protrusion 85 are formed in the protruding shape, but when necessary, only the detergent outlet 815 may protrude from the bottom surface of the storage body 81 and may be accommodated in the detergent intake 715. In other words, the storage protrusion 85 and the mounting receiving groove 75 may be formed as the detergent outlet 815 and the detergent intake 715. That is, a separate component called the storage protrusion 85 is not formed separately, but only the detergent outlet 815 is formed to protrude from the storage body 81, so that the detergent outlet 815 may perform the function of the storage protrusion 85.

Additionally, in another embodiment, the storage protrusion 85 may include a plurality of storage protrusions. Alternatively, the detergent outlet 815 may not protrude and only the storage protrusion 85 may protrude. Alternatively, the storage protrusion 85 may not protrude and only the detergent outlet 815 may protrude.

That is, the storage protrusion 85 may include any structure that is disposed on the storage body to be spaced apart from the storage coupling portion 83 in the direction parallel to the ground and protrudes from the storage body 81 to the mounting body 71.

In addition, as described above, the storage body 81 is seated on the mounting body 71 of the top cover 12. Because the mounting body 71 may be disposed on the top cover 12 at the rear of the laundry inlet 124, a length of the mounting body 71 in a front and rear direction (the X-axis direction) may be smaller than a length thereof in the width direction (the Y-axis direction). Accordingly, the storage body 81 may also have a length in the front and rear direction smaller than a length in the width direction.

In this regard, the storage protrusion 85 and the storage coupling portion 83 may be spaced apart from each other in the width direction of the storage body 81. That is, the storage coupling portion 83 may be disposed to be close to one side of the storage body 81 in the width direction, and the storage protrusion 85 may be disposed to be close to the other side of the storage body 81.

More preferably, the storage coupling portion 83 may be disposed adjacent to the side surface exposed to the outside of the storage body 81 such that the grip protrusion 837 of the storage coupling portion 83 is exposed, and the storage protrusion may be disposed on the other side of the storage coupling portion 83.

That is, as such, the storage coupling portion 83 and the storage protrusion 85 are arranged on one side and the other side in the width direction with the length greater than that of the front and rear direction, so that the storage coupling portion 83 and the storage protrusion 85 may be spaced far apart from each other. As a result, a force that offsets the pivoting moment when the storage protrusion 85 pivots may be strengthened around the storage coupling portion 83.

(a) in FIG. 13 is a diagram showing a storage and a mounting portion before being coupled to each other, and (b) in FIG. 13 is a diagram showing locations of a fixing protrusion and a mounting coupling portion in (a) in FIG. 13.

As shown in (a) in FIG. 13, as the storage 8 moves downward to be mounted on the mounting portion 7, the fixing protrusion 833 comes into contact with the first mounting member 731. At this time, the storage body 81 is spaced apart from the mounting portion 7 by L1. At this time, the fixing body 831 is disposed at the first location by the elastic portion 835 until the moment the fixing protrusion 833 comes into contact with the first mounting member 731.

As shown in (b) in FIG. 13, the fixing protrusion 833 may come into contact with the first inclined surface 731*a* of the first mounting member 731. More specifically, the fixing protrusion 833 may have a fixing inclined surface 833*a* that comes into contact with the first inclined surface 731*a* when the storage 8 is coupled to the mounting portion 7.

The fixing inclined surface 833*a* may be inclined at an angle corresponding to the first inclined surface 731*a*, and may be guided in the direction of the second location while making surface contact with the first inclined surface 731*a*. That is, the fixing inclined surface 833*a* may be inclined in a shape corresponding to the first inclined surface 731*a* to achieve stable surface friction with the first inclined surface 731*a*.

In addition, because of the structure of such fixing inclined surface 833*a*, the storage body 81 may be prevented from excessively flowing downward by the detergent and colliding with the mounting body 71. That is, for the fixing protrusion 833 to be stably guided in consideration of a weight of the storage body 81, the fixing protrusion 833 may have the fixing inclined surface 833*a* inclined in the shape corresponding to the first inclined surface 731*a*.

(a) in FIG. 14 is a diagram showing a storage and a mounting portion being coupled to each other, and (b) in FIG. 14 is a diagram showing locations of a fixing protrusion and a mounting coupling portion in (a) in FIG. 14.

As shown in (a) in FIG. 14, as the storage 8 is coupled to the mounting portion 7, the distance between the storage body 81 and the mounting body 71 is reduced from L1 to L2. As described above, the fixing body 831 is coupled to the storage body 81 to translate between the first location and the second location by the installation portion 817.

When the distance between the storage body 81 and the mounting body 71 becomes smaller, the fixing inclined surface 833*a* of the fixing protrusion 833 is rubbed along the first inclined surface 731*a* of the first mounting member 731 and moves in the direction from the first location to the second location. That is, the fixing body 831 is disposed between the first location and the second location.

In this regard, because the grip protrusion 837 exposed to the outside also moves in the direction of the second location, the user may visually recognize that the mounting coupling portion and the storage coupling portion are coupled to each other.

As shown in (b) in FIG. 14, as the storage body 81 moves downward and the distance between the storage 8 and the mounting portion 7 becomes smaller, the fixing inclined surface 833*a* moves in the direction of the second location while being guided by the first inclined surface 731*a*. That is, the downward movement of the storage body 81 may be converted into the movement toward the second location of the fixing protrusion 833 by the first inclined surface 731*a*. When the fixing protrusion 833 moves in the direction of the second location, the fixing body 831 coupled to the fixing protrusion 833 may also move in the direction of the second location.

(a) in FIG. 15 is a drawing showing a storage and a mounting portion coupled to each other, and (b) in FIG. 15 is a diagram showing locations of a fixing protrusion and a mounting coupling portion in (a) in FIG. 15.

As shown in (a) in FIG. 15, as the storage 8 and the mounting portion 7 are coupled to each other, the distance between the storage body 81 and the mounting body 71 may be minimized. At this time, it may be seen that the fixing body 831 and the grip protrusion 837 are disposed back at the first location by the force provided by the elastic portion 835.

That is, when the storage 8 and the mounting portion 7 are coupled to each other, the fixing body 831 is disposed at the first location, then at the location between the first location and the second location, and then again at the first location.

As shown in (b) in FIG. 15, the fixing protrusion 833 may include a fixing support surface 833*b* extending from one end disposed at a top of the fixing inclined surface 833*a* in the direction of the second location. The fixing support surface 833*b* may form a top surface of the fixing protrusion 833.

The fixing protrusion 833 moves in the direction of the second location along the first inclined surface 731*a*, and when the top surface (the fixing support surface) 833*b* of the fixing protrusion 833 is disposed under the fixing surface 731*b*, moves again in the direction of the first location by the force provided by the elastic portion 835.

Specifically, as the storage body 81 further descends, the moment an upper end of the fixing protrusion 833 is disposed under the fixing surface 731*b*, the fixing protrusion 833 moves in the direction of the first location by the elastic portion 835 and the fixing protrusion 833 is disposed under the fixing surface 731*b*. Because the top surface (the fixing support surface) 833*b* of the fixing protrusion 833 is in contact with the fixing surface 731*b*, the upward movement of the fixing protrusion 833 is restricted. Accordingly, the upward movement of the storage body 81 may be restricted.

That is, when the fixing protrusion 833 also descends by the descending of the storage body 81 and is disposed under the fixing surface 731*b*, the fixing protrusion 833 moves under the fixing surface 731*b*. In this regard, as described above, the fixing body 831 coupled to the fixing protrusion 833 is disposed at the first location and is restricted from moving upward.

(a) in FIG. 16 is a diagram showing a storage coupled to a mounting portion, and (b) in FIG. 16 is a diagram showing a storage being separated from a mounting portion.

As shown in FIG. 16, when the grip protrusion 837 is disposed at the first location and then at the second location, as the storage body 81 is spaced apart from the mounting portion 7, the coupling of the storage 8 and the mounting portion 7 may be released.

That is, when the fixing body 831 moves from the first location to the second location, the coupling of the storage coupling portion 83 and the mounting coupling portion 73 is released.

The above-described structure in which the above-described fixing protrusion 833 moves in the direction of the second location by the first inclined surface 731*a* and is disposed under the fixing surface 731*b* is only one example and the present disclosure is not limited thereto.

For example, when the storage body 81 moves downward and approaches the mounting body 71, the fixing protrusion 833 may move downward from above the second mounting member 732. In other words, the fixing protrusion 833 simply needs to be disposed on the second mounting member 732, and the fixing protrusion 833 does not need to be guided by the first inclined surface 731*a* and move in the direction of the second location.

That is, when the storage 8 and the mounting portion 7 are coupled to each other, the fixing protrusion 833 does not necessarily need to be in contact with the first mounting member 731 and the second mounting member 732. The fixing protrusion 833 may be in a structure of moving downward into a space between the first mounting member 731 and the second mounting member 732 and then moving to the first location by the elastic portion or the like and disposed under the first inclined surface 731*a*.

(a) in FIG. 17 shows a storage and a mounting portion being separated from each other as a mounting body moves to a second location, and (b) in FIG. 17 is a diagram showing locations of a fixing protrusion and a mounting coupling portion in (a) in FIG. 17.

As shown in (a) in FIG. 17, when the fixing body 831 or the grip protrusion 837 moves from the first location to the second location while the storage 8 and the mounting portion 7 are coupled to each other, it may be seen that the storage body 81 is spaced apart from the mounting body 71 by L3. In this regard, L3 may be smaller than L1 and L2.

As shown in (b) in FIG. 17, when the fixing body moves from the first location to the second location, a lower end of the fixing protrusion may be guided to the second inclined surface 732*a* while moving in the direction of the second location along the guide surface 732*d* of the second mounting member 732.

As described above, when the fixing body 831 moves in the direction of the second location, the top surface (the fixing support surface) 833*b* of the fixing protrusion 833 is spaced apart from the fixing surface 731*b* in the direction of the second location, and thus, the fixing protrusion 833 is free to move upward. That is, as the fixing body 831 moves in the direction of the second location, the coupling (the engagement) between the fixing protrusion 833 and the first mounting member 731 is released.

In this regard, when the fixing body 831 moves further in the direction of the second location, a lower end of the fixing protrusion 833 moves along the second inclined surface 732*a*, and the storage body 81 moves upward and is spaced apart by L4. In this regard, L4 is greater than L3.

That is, the second inclined surface 732*a* may convert the movement of the fixing body in the direction of the second location into the upward movement of the storage body 81.

In one example, the lower end of the fixing protrusion 833 may be rounded to minimize friction by reducing an area size in contact with the second inclined surface 732*a*. This is because it is necessary to minimize the friction as the movement of the fixing body 831 in the second location is generally accomplished by the user pushing the grip protrusion 837 with the hand.

(a) in FIG. 18 shows a storage and a mounting portion separated from each other as a mounting body moves to a second location, and (b) in FIG. 18 is a diagram showing locations of a fixing protrusion and a mounting coupling portion in (a) in FIG. 17.

As shown in (a) in FIG. 18, when the fixing body 831 is disposed at the second location, the storage body 81 is further spaced apart from the mounting body 71. When the fixing body 831 is disposed at the second location, the fixing body 831 does not move in the direction of the first location because of the stopping protrusion 732*c* and remains disposed at the second location. The user may view the fixing body 831 or the grip protrusion 837 disposed at the second location and identify that the coupling of the mounting coupling portion 73 and the storage coupling portion 83 has been released (or the fixing protrusion and the first mounting member are separated from each other).

In such state, when the storage body 81 is further moved upward as shown in FIG. 4, as the storage protrusion 85 may upwardly come out of the mounting receiving groove 75, the storage 8 may be completely separated from the mounting portion 7.

As shown in (b) in FIG. 18, when the fixing body 831 moves in the direction of the second location and is disposed on a side of the second location, the fixing protrusion 833 moves along the second inclined surface 732*a* and is then disposed on the released surface 732*b*. The fixing protrusion 833 disposed on the release surface 732*b* may be restricted from moving in the first direction by the stopping protrusion 723*c*.

In other words, when the fixing body 831 moves to the second location and the fixing protrusion 833 is disposed closer to the second location than the stopping protrusion 732*c* (or at the second location), the fixing protrusion 833 is disposed on the release surface 732*b* and is restricted from moving back to the second inclined surface 732*a* by the stopping protrusion 723*c*.

With the above-described configuration, when the fixing body 831 is disposed at the second location, the fixing body 831 no longer moves to the first location. In this regard, because the storage coupling portion and the mounting coupling portion 73 are uncoupled (or separated) from each other, the storage body 81 is free to move upward (in the +Z-axis direction).

That is, when the storage body 81 is moved downward and seated on the mounting body 71 while the storage protrusion 85 is inserted into the mounting receiving groove 75, the storage coupling portion and the mounting coupling portion are coupled to each other and the fixing body 831 (or the grip protrusion 837) is disposed at the first location.

Additionally, when the fixing body 831 disposed at the first location is moved to the second location, the coupling of the storage coupling portion and the mounting coupling portion may remain released.

In one example, unlike as described above, when the user removes the force applied to the fixing body 831 in the direction of the second location before the fixing protrusion 833 is disposed on the release surface 732*b*, the fixing body 831 moves back in the direction of the first location by the elastic portion 835. When the fixing body 831 moves back to the first location by the elastic portion 835, the fixing protrusion 833 may move along the second inclined surface 732*a* and may be disposed under the fixing surface 731*b*, so that the fixing protrusion 833 may be restricted from moving upward. In other words, when the user removes force while placing the fixing body 831 between the first location and the second location before placing the fixing body 831 at the second location, the fixing body 831 may move back to the first location and may be restricted from moving upward.

FIG. 19 is a diagram showing a storage coupling portion according to another embodiment of the present disclosure.

As shown in FIG. 20, the first location and the second location may be reversed depending on the structures of the storage coupling portion 83, the mounting coupling portion 73, and the installation portion 817 (see FIG. 10).

Referring to FIG. 10 described above, the first location (the coupling location) is a front side with respect to the cabinet 1 and the second location (the separation location) is a rear side with respect to the cabinet 1. Referring to FIG. 19, it may be seen that the first location (the coupling location) is the rear side with respect to the cabinet 1 and the second location (the separation location) is the front side with respect to the cabinet 1. In other words, it may be seen that the first location and the second location may be changed by reversing the arrangement structures of the mounting coupling portion and the storage coupling portion described above.

As described above, the second location in FIG. 10 is shown as a location close to the rear side with respect to the cabinet 1. In such structure, the user must grip the grip protrusion 837 and apply the force rearward to release the coupling of the storage 8 and the mounting portion 7. However, when excessive force is applied rearward, the storage 8 may fall rearwardly of the cabinet 1. Because the space at the rear of the cabinet 1 is generally difficult for the user to access, there may be inconvenience when separating the storage 8.

As described above, the second location in FIG. 19 is shown as the location close to the front side with respect to the cabinet 1. In such structure, the user grips the grip protrusion 837 and applies the force in the direction of the second location (the forward direction) to release the coupling of the storage coupling portion 83 and the mounting coupling portion 73. At this time, the user may apply the excessive force and the storage 8 may fall forwardly of the cabinet 1. Because it is common for the user to manipulate the laundry treating apparatus 100 on the front surface of the cabinet 1, the user may easily access the storage 8 that has been fallen.

In the above-described drawings, the first location and the second location are illustrated as being close to the front side or close to the rear side with respect to the cabinet 1, but the present disclosure is not necessarily limited thereto. In one example, the first location and the second location may be implemented at a left side or a right side with respect to the cabinet 1 based on the change in the above-described structure.

That is, the first location and the second location are sufficient as long as they are defined in the direction (the X-axis direction and the Y-axis direction) perpendicular to the direction in which the storage 8 is coupled (the vertical direction, the Z-axis direction), and are not limited to specific locations.

FIGS. 20 and 21 are diagrams showing a storage coupling portion according to another embodiment of the present disclosure.

As shown in FIG. 20, the grip protrusion 837 may have a plurality of protruding ribs 837*a* to improve a frictional force when the user grips the grip protrusion 837. The user may manipulate the fixing body 831 by pushing the plurality of ribs 837*a* protruding from the grip protrusion 837.

Additionally, as shown in FIG. 21, the storage coupling portion 83 may have a protrusion 837*b* protruding from a surface of the grip protrusion 837. The user may move the fixing body 831 by gripping the protrusion protruding from the grip protrusion 837*b* with the hand thereof.

Accordingly, convenience of use may be improved when the user moves the fixing body 831 disposed at the first location to the second location (when releasing the coupling of the storage coupling portion 83 and the mounting coupling portion 73).

Although the present disclosure has been illustrated and described in connection with the specific embodiment, it would be obvious to a person skilled in the art that the present disclosure may be variously modified and changed without departing from the technical spirit of the present disclosure provided by the claims below.

The invention claimed is:

1. A laundry treating apparatus comprising:

a cabinet including a top cover having a laundry inlet defined therein;

a tub disposed inside the cabinet, the tub being configured to receive water therein;

a drum rotatably located inside the tub, the drum being configured to receive laundry therein;

a mounting portion located on the top cover, a portion of the mounting portion being exposed to outside the cabinet;

a storage detachably coupled to the mounting portion, the storage being configured to store detergent therein;

a storage protrusion protruding downward from the storage, the storage protrusion being configured to be inserted into the mounting portion; and a storage coupling portion located on the storage, the storage coupling portion being spaced apart from the storage protrusion, the storage coupling portion being configured to be coupled to the mounting portion such that, when at least a portion of the storage coupling portion is inserted into the mounting portion, the storage is restricted from moving vertically relative to the cabinet, wherein the mounting portion includes a mounting receiving groove configured to accommodate the storage protrusion and guide coupling of the storage.

2. The laundry treating apparatus of claim 1, wherein the storage coupling portion includes:

a fixing body located on the storage; and a fixing protrusion extending from the fixing body, the fixing body being movable between a first location in which the fixing protrusion contacts the mounting portion to restrict upward movement of the storage and a second location in which the fixing portion is separated from the mounting portion.

3. The laundry treating apparatus of claim 2, wherein, when the fixing body is located at the first location, the storage coupling portion is coupled to the mounting portion, and wherein the coupling of the storage coupling portion and the mounting portion is released as the fixing body moves from the first location to the second location.

4. The laundry treating apparatus of claim 3, wherein the storage coupling portion further includes an elastic portion located at the fixing body, the elastic portion being configured to apply a force to the fixing body in a direction towards the first location, and wherein the storage further includes a guide configured to guide the fixing body to move between the first location and the second location.

5. The laundry treating apparatus of claim 4, wherein the fixing body further includes a guide groove recessed therein, the guide groove having a length equal to or greater than a distance the fixing body moves between the first location and the second location, and wherein the guide is at least partially inserted into the guide groove.

6. The laundry treating apparatus of claim 3, wherein the mounting portion is located rearward of the laundry inlet, wherein the storage is detachable from the mounting portion in a vertical direction of the cabinet, and wherein the fixing body is configured to move in a front and rear direction or in a left and right direction relative to the laundry inlet.

7. The laundry treating apparatus of claim 6, wherein, when the fixing body moves rearward while the storage and the mounting portion are coupled to each other, the coupling of the storage and the mounting portion is released.

8. The laundry treating apparatus of claim 3, wherein the storage coupling portion further includes a grip protrusion protruding from the fixing body in a direction opposite to a protrusion direction of the fixing protrusion, the grip protrusion being exposed to outside of the storage.

9. The laundry treating apparatus of claim 3, further comprising a mounting coupling portion located on the mounting portion at a location corresponding to the storage coupling portion, the mounting coupling portion including a first fixing member configured to be coupled to the fixing protrusion when the fixing body is in the first location, the first fixing member including:

a first inclined surface configured to contact the fixing protrusion during coupling of the storage to the mounting portion, the first inclined surface extending downward and towards the second location; and a fixing surface extending from a lower end of the first inclined surface towards the first location.

10. The laundry treating apparatus of claim 9, wherein, when the storage coupling portion and the mounting coupling portion are coupled to each other, the fixing surface is disposed upwardly of an upper end of the fixing protrusion to restrict upward movement of the storage.

11. The laundry treating apparatus of claim 9, wherein the storage is configured such that:

the fixing protrusion moves from the first location towards second location while being in contact with the first inclined surface when the storage is coupled to the mounting portion, and the fixing portion moves under the fixing surface while moving from the second location towards the first location when an upper end of the fixing protrusion is located downwardly of the lower end of the first inclined surface.

12. The laundry treating apparatus of claim 9, wherein the fixing protrusion includes:

a first protruding surface corresponding to the first inclined surface; and a second protruding surface extending from an upper end of the first protruding surface, the second protruding surface configured to come into contact with the fixing surface of the first fixing member once the storage is coupled to the mounting portion.

13. The laundry treating apparatus of claim 9, wherein the mounting coupling portion further includes a second fixing member spaced from the first fixing member, the second fixing member being located closer to the second location than to the first fixing member when the storage is coupled to the mounting portion, the second fixing member including a second inclined surface inclined downward towards the first location, the second inclined surface being configured to guide the fixing protrusion such that a lower end of the fixing protrusion is moved upwardly of the fixing surface as the fixing body moves toward the second location.

14. The laundry treating apparatus of claim 13, wherein the second fixing member further includes a release surface extending from an upper end of the second inclined surface towards the second location, the release surface including a stopping protrusion restricting movement of the fixing protrusion towards the second inclined surface.

15. The laundry treating apparatus of claim 14, wherein the upper end of the second inclined surface is located downwardly of the fixing surface.

16. The laundry treating apparatus of claim 14, wherein the storage protrusion is at least partially inserted into the mounting portion and is restricted from moving upward when the storage is coupled to the mounting portion and the fixing body is located at the first location, and wherein the storage protrusion is configured to be separated from the mounting portion when the fixing body is located at the second location.

17. The laundry treating apparatus of claim 14, wherein the fixing protrusion is restricted from moving towards the first location by the stopping protrusion when a lower end of the fixing protrusion is located on the release surface, and wherein the fixing protrusion is configured to move towards the first location to be located under the fixing surface when the lower end of the fixing protrusion is located above the second inclined surface.

18. The laundry treating apparatus of claim 17, wherein the storage is detachably coupled to the mounting portion in the vertical direction of the cabinet, and wherein the storage is configured to be separated from the mounting portion by being spaced apart therefrom when the fixing body moves toward the second location while the storage is coupled to the mounting portion.

19. The laundry treating apparatus of claim 1, wherein the storage protrusion is configured to discharge the detergent stored in the storage, and wherein the mounting receiving groove is configured to deliver the detergent discharged from the storage protrusion to the tub.

20. The laundry treating apparatus of claim 1, further comprising:

a detergent outlet spaced apart from the storage protrusion, the detergent outlet being located between the storage coupling portion and the storage protrusion, the detergent outlet extending downward from the storage, the detergent outlet being configured to discharge the detergent; and a detergent intake located in the mounting portion, the detergent intake being configured to receive the detergent outlet therein and to deliver the detergent to the tub.

* * * * *